US006505027B2

(12) United States Patent
Takeuchi et al.

(10) Patent No.: US 6,505,027 B2
(45) Date of Patent: Jan. 7, 2003

(54) IMAGE FORMING APPARATUS WITH TONER HAVING RELEASING AGENT IN A BINDER

(75) Inventors: Akihiko Takeuchi, Susono (JP); Masahiro Suzuki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/775,582

(22) Filed: Feb. 5, 2001

(65) Prior Publication Data

US 2001/0022909 A1 Sep. 20, 2001

(30) Foreign Application Priority Data

Feb. 7, 2000 (JP) ..... 2000-028966

(51) Int. Cl.[7] ..... G03G 15/20

(52) U.S. Cl. ..... 399/328; 219/216; 399/330; 430/124

(58) Field of Search ..... 399/328, 329, 399/330, 331, 333; 219/216, 635, 647, 652, 469; 430/120, 124

(56) References Cited

U.S. PATENT DOCUMENTS

| | | | | |
|---|---|---|---|---|
| 5,331,385 A | | 7/1994 | Ohtsuka et al. | 399/331 |
| 5,543,904 A | | 8/1996 | Kato et al. | 399/335 |
| 5,745,833 A | * | 4/1998 | Abe et al. | 399/330 |
| 6,005,594 A | | 12/1999 | Nanataki et al. | 347/156 |
| 6,021,303 A | * | 2/2000 | Terada et al. | 399/328 |
| 6,057,074 A | * | 5/2000 | Matsuda et al. | 430/124 |
| 6,131,010 A | | 10/2000 | Kume et al. | 399/333 |

FOREIGN PATENT DOCUMENTS

| | | |
|---|---|---|
| JP | 51-109739 | 4/1976 |
| JP | 63-313182 | 12/1988 |
| JP | 2-157878 | 6/1990 |
| JP | 4-44075 | 2/1992 |
| JP | 4-204980 | 7/1992 |
| JP | 410293426 | * 11/1998 |

* cited by examiner

*Primary Examiner*—Hoan Tran
(74) *Attorney, Agent, or Firm*—Fitzpatrick, Cella, Harper & Scinto

(57) ABSTRACT

The present invention provides an image forming apparatus that has unfixed toner image forming device for forming unfixed toner images, and fixing device for fixing on a recording material the unfixed toner image formed by the unfixed toner image forming device, wherein the fixing device includes a film, a first back up member and a second back up member which sandwich the film therebetween and are in pressure contact with each other to form a nip portion, and device for increasing a temperature of the film, nips and conveys the recording material bearing the unfixed toner image between the film and the second back up member at the nip portion, and fixes the unfixed toner image on the recording material, wherein toner of the unfixed toner image contains a releasing agent in a binder which contains a coloring material ingredient and have a melt index value of 0.5 g or more and 100 g or less in accordance with a Melt Index measuring method, and wherein an average surface pressure at the nip portion is $5.9\times10^4$ Pa or more and $24.5\times10^4$ Pa or less.

19 Claims, 11 Drawing Sheets

SHAPE FACTOR SF1

$$SF1 = \frac{(MXLNG)^2}{AREA} \times \frac{\pi}{4} \times 100$$

SHAPE FACTOR SF2

$$SF2 = \frac{(PERI)^2}{AREA} \times \frac{1}{4\pi} \times 100$$

IMAGE FORMING APPARATUS WITH TONER HAVING RELEASING AGENT IN A BINDER

BACKGROUND OF THE INVENTION

1. Field of the Invention

The present invention relates to image forming apparatus such as copying machine, facsimile, printer, etc. and, in particular, to apparatus in which a color image, images of different colors are superimposed, is formed and borne on a recording material and the recording material is heated and pressurized by an image fixing means so as to fix the color image thereon.

2. Related Background Art

As fixing apparatus (fixing devices) used in image forming apparatus for fixing an unfixed toner image, which is indirectly (by means of transferring) or directly formed and borne on a recording material (paper) by a proper image forming process means such as electrophotographic process, on the surface of the recording material as a permanent fixed image by the application of heat, those adopting the heat roller fixing method have been widely in use.

In recent years, there have been put to practical use apparatus adopting the heater type film heating fixing method from the standpoint of quick start and saving energy. Further, there have been proposed apparatus adopting the electromagnetic induction film heating fixing method which causes a film of metal itself heat generation.

a) Fixing Apparatus adopting the Heater Type Film Heating Fixing Method

There are disclosed fixing apparatus adopting the film heating fixing method in, for example, Japanese Patent Application Laid-Open No. 63-313182, Japanese Patent Application Laid-Open No. 2-157878, Japanese Patent Application Laid-Open No. 4-44075, and Japanese Patent Application Laid-Open No. 4-204980.

Specifically, these fixing apparatus are such that they have a pressure contacting nip portion (hereinafter referred to as fixing nip portion) formed therein by sandwiching a heat-resistant film (hereinafter referred to as fixing film) between a ceramic heater as a heating body and a pressurizing roller as a pressurizing member, introduce a recording material having an unfixed toner image formed and borne thereon between the fixing film and the pressurizing roller at the above fixing nip portion, convey the recording material together with the fixing film while allowing the same to be nipped between the ceramic heater and the pressurizing roller so as to apply pressuring force of the fixing nip portion to the recording material while providing the same with heat of the ceramic heater via the fixing film, thereby fix the unfixed toner image on the surface of the recording material.

The fixing apparatus adopting the film heating fixing method offer the advantages that they can constitute an on-demand type fixing apparatus using a member with a low heat capacity for the ceramic heater and the film, they should apply current to the ceramic heater as a heat source only when executing image formation to cause the ceramic heater heat generation at a predetermined temperature, their latency from the instance of turning on them until they are in state where they can execute image formation is short (a quick start characteristic), and that they have a substantially low power consumption when standing by (power saving).

b) Fixing Apparatus adopting the Electromagnetic Induction Film Heating Fixing Method There is disclosed in Japanese Utility Model Application Laid-Open No. 51-109739 a fixing apparatus adopting the electromagnetic induction film heating fixing method which induces an eddy current in a metal layer (heat generating layer) of the fixing film with magnetic flux and causes the metal layer Joule heat generation. This fixing apparatus enables the direct heat generation of the fixing film utilizing the generation of an induced current and has accomplished a highly efficient fixing process compared with the fixing apparatus adopting the heat roller fixing method which utilizes a halogen lump as a heat source.

Depending on the arrangement of coils and a core, however, since the energy of the alternating magnetic flux generated by excitation coils as magnetic field generating means is used for heating the entire fixing film, the radiation loss is big. As a result, there have been cases where the rate of the making energy applied to the fixing process is low, and hence, an inefficient fixing process.

Thus, there has been provided a highly efficient fixing apparatus in which excitation coils are arranged closer to a fixing film, as a heat generating element, and the alternating magnetic flux distribution of the excitation coils is concentrated on the vicinity of the fixing nip portion, so as to obtain the energy to be applied to the fixing more efficiently.

FIG. 16 is a schematic view of the construction of one example of fixing apparatus adopting the electromagnetic induction film heating fixing method which has increased the fixing efficiency by concentrating the alternating magnetic flux distribution of the excitation coils on the fixing nip portion.

In the same figure, reference numeral 10 denotes a cylindrical fixing film, as a rotary body, including electromagnetic induction heat generating layers (conductive material layer, magnetic material layer, resistor layer).

Reference numeral 16 denotes a gutter-shaped film guide member of which cross section is almost semicircular, and the cylindrical fixing film 10 is loose-fit on the outside of this film guide member 16.

Reference numeral 15 denotes a magnetic field generating means placed on the inside of the film guide member 16, which consists of excitation coils 18 and an E-shaped magnetic core (core material) 17.

Reference numeral 30 denotes an elastic pressurizing roller, which forms a fixing nip portion N having a predetermined width in combination with the bottom of the film guide member 16 with a predetermined pressure contacting force while nipping the fixing film 10 at the fixing nip portion and allowing the same to mutually come in pressure contact with the elastic pressurizing roller and the bottom of the film guide member.

The magnetic core 17 of the above magnetic filed generating means 15 is placed in such a manner as to correspond to the fixing nip portion N.

The pressurizing roller 30 is rotatively driven by a driving means M in the counterclockwise direction shown by an arrow. When rotatively driving the pressurizing roller 30, torque acts on the fixing film 10 by the friction force generated between the above pressurizing roller 30 and the external surface of the fixing film 10; consequently, the above fixing film 10 is rotated around the periphery of the film guide member 16 at a peripheral speed almost corresponding to that of the pressurizing roller 30 in the clockwise direction shown by an arrow with its internal surface closely touching and sliding on the bottom of the film guide member 16 at the fixing nip portion N (pressuring roller drive fixing method).

The film guide member 16 serves to pressurize the fixing nip portion N, support the excitation coils 18 and the magnetic core 17, as a magnetic field generating means 15, support the fixing film 10, and stabilize the conveyance of the above film 10 during the rotation thereof. This film guide member 16 is an insulating member which does not interfere with magnetic flux's passing and a material is used for it which can resist heavy loads.

The excitation coils 18 generate alternating magnetic flux with alternating current supplied from an excitation circuit not shown in the figure. The alternating magnetic flux distributes intensively at the fixing nip portion N due to the E-shaped magnetic core 17 placed in such a manner as to correspond to the position of the fixing nip portion N and generates an eddy current in the electromagnetic induction heat generating layers of the fixing film 10 at the fixing nip portion N. This eddy current generates Joule heat due to the resistivity of the electromagnetic induction heat generating layers. The electromagnetic induction heat generation of the fixing film 10 occurs intensively at the fixing nip portion N where alternating magnetic flux is allowed to distribute intensively, the fixing nip portion N is thereby heated at a high efficiency.

The temperature of the fixing nip portion N is controlled to keep the portion at a fixed temperature by controlling the current supply to the excitation coils 18 with a temperature control system including a temperature detecting means not shown in the figure.

Thus, the pressurizing roller 30 is rotatively driven, and with the rotational motion of the pressurizing roller, the cylindrical fixing film 10 starts to rotate around the periphery of the film guide member 16, the electromagnetic induction heat generation is caused in the fixing film 10 by the feed from the excitation circuit to the excitation coils 18 as described above, and the fixing nip portion N is heated to a fixed temperature. In state where the temperature of the fixing nip portion N is being controlled, a recording material P, which is conveyed from the portion of an image forming means not shown in the figure and has an unfixed toner image t formed thereon, is introduced between the fixing film 10 and the pressurizing roller 30 at the fixing nip portion N with the image side facing up, that is, with the image side facing the surface of the fixing film. At the fixing nip portion N, the image side closely touches the external surface of the fixing film 10, and the recording material P is conveyed together with the fixing film 10 through the fixing nip portion N while being nipped between the fixing film 10 and the pressurizing roller 30. During the process of being conveyed together with the fixing film 10 through the fixing nip portion N while being nipped between the fixing film 10 and the pressurizing roller 30, the recording material P is heated due to the electromagnetic induction heat generation of the fixing film 10, and the unfixed toner image t is heat fixed on the recording material P. The recording material P having passed through the fixing nip portion N is separated from the external surface of the rotating fixing film 10 and conveyed to be discharged.

Now toners used in full color image forming apparatus and the process of fixing the same will be described.

Toners for use in the full color image forming process which adopts, for example, electophotographic process are required to exhibit excellent melting and color mixing characteristics when applying heat thereto, and preferably those having sharp melting characteristics, that is, those having a low softening point and a low melt viscosity are used.

The use of such sharp melting toners enables the broader range of color reproduction of reproduced matter, and color copies faithfully reproducing the original image can be obtained.

Such highly sharp melting color toners, however, have a strong affinity for a fixing roller or a fixing film, and they are apt to offset on the fixing roller or the fixing film during the fixing operation.

Particularly in a fixing apparatus of a color image forming apparatus, since more than one toner layers: magenta, cyan, yellow and black layers are formed on a recording material, their offsets are very likely to occur.

Now the problems attendant to the use of sharp melting toners will be described taking the case of a fixing apparatus adopting the heat roller fixing method. In such a fixing apparatus, releasing agents, such as silicone oil, have been applied to the fixing roller in order to promote the releasing tendency of toners therefrom.

In this image forming process, however, there have been created difficulties as follows.

In the currently used fixing system in which releasing agents such as oil are applied to the fixing roller, its body inevitably has a complex construction, which makes its maintenance difficult, and moreover, the application of oil gives rise to a problem of promoting decrease in life of the fixing roller.

With the diversification of needs for copy in recent years, and perhaps because of the ecology boom of today, the needs for the image forming process what is called the double-side copy, which forms images on both sides of a recording material and reduces the consumption of paper, are increasing day by day.

Under these circumstances, in the fixing system in current use in which releasing agents such as oil are applied to the fixing roller, there has arisen another difficulty that part of the toner fixed on the recording material in the first fixing operation is likely to offset in the second fixing operation.

The problems as described above have arisen, when using sharp melting toners, in the fixing apparatus a), b) which adopt the heater type film heating fixing method and the electromagnetic induction film heating fixing method, respectively, in the same way as in the fixing apparatus adopting the heat roller fixing method. In such fixing apparatus, oil must be applied to the film portion in order to part a toner from the fixing film, which has resulted in production of various oil-related problems.

On the other hand, there is a method of solving the above problems at a stroke which uses a toner having wax, as a releasing agent, contained in its binder which contains a coloring material ingredient. According to this method, oil needs not be applied to the fixing members such as fixing roller and fixing film, and occurrence of offsets can be prevented because the wax ingredient oozed from the toner at the fixing nip portion adheres to the surface of the fixing members and forms a releasing layer thereon during the fixing operation.

In recent years, however, with the spread of color printing, not only photo images but also ordinary business documents are more often printed out in color; from this standpoint, there have been increasing demands that the gloss of images should be kept to a minimum. In this respect, there have been demands even for the above toner to be designed in such a manner as to allow the printed image on which the toner has been fixed to be less glossy without decreasing its melt viscosity very much (the sharp melting toner in current use has a low viscosity).

The matters described so far can be put together to form the following viewpoint. As a full color image fixing system for realizing easy image maintenance and satisfactory double-side images while accomplishing on-demand performance as well as energy saving, preferably an image forming apparatus is constructed in such a manner that it includes a fixing apparatus adopting the heater type film heating fixing method or the electromagnetic induction film heating fixing method, like a) or b) described above, and the toner having a releasing agent contained its binder which contains a coloring material ingredient is applied thereto.

Further, as an image characteristic of color images including business documents, preferably the glossiness of the images is not very high and has a moderate gloss value; accordingly, it is necessary not to reduce the melt viscosity of the toner described above very much, but to keep it moderately viscous.

However, when performing fixing operation of the wax-containing toner having characteristics as described above in the above fixing apparatus, as shown in FIG. 16, which adopts the electromagnetic induction film heating fixing method, the following new problems were created.

(1) When the contact pressure between the fixing film 10 and the pressurizing roller 30 was low at the fixing nip portion N, the toner was not melted smoothly, and there occurred a fine mosaic-like image defect known as "pore" in the images of both middle tone and high density. Particularly in the transparent sheets for use in overhead projectors (OHP), the phenomenon was remarkable and the projected image deteriorated considerably.

(2) When the contact pressure between the fixing film 10 and the pressurizing roller 30 was increased so as to avoid the defect described in (1), there occurred a fixing defect in the form of blistering in the high-density image portion (refer to FIG. 17). Presumably the reason for this defect to occur is that, because a high pressure was applied to the toner in state where its surface was melted, but its interior portion was not completely melted, an anchor effect of the toner on paper (recording material) was not fully produced; therefore, the surface of the toner was pulled on the fixing film side when releasing the toner from the film. Further, when the fixing member was a film, like in this case, there arose a problem that a high contact pressure was likely to cause deterioration and damage to the film.

The phenomena described in (1) and (2) are conflicting with each other, as a result, satisfactory images could not be obtained, and there have been demands for suitable fixing conditions. The above phenomena were also observed in a fixing apparatus adopting the heater type film heating fixing method.

SUMMARY OF THE INVENTION

Accordingly, an object of the present invention is to provide an image forming apparatus which starts up quickly and is capable of forming satisfactory images.

Another object of the present invention is to provide an image forming apparatus including an unfixed toner image forming means for forming unfixed toner images and a fixing means for fixing on a recording material the unfixed toner images formed by the unfixed toner image forming means, in which the fixing means includes a film, first and second back up members which sandwich the film therebetween and are in pressure contact with each other to form a nip portion, and a heating means for increasing the temperature of the film, nips and conveys the recording material, bearing the unfixed toner image between the film and the second back up member at the nip portion, and fixes the unfixed toner image on the recording material, the toner of the unfixed toner image contains a releasing agent in a binder which contains a coloring material ingredient and have a melt index value of 0.5 g or more and 100 g or less in accordance with the Melt Index measuring method, and the average pressure at the nip portion is $5.9\times10^4$ Pa or more and $24.5\times10^4$ Pa or less.

Still another object of the present invention is to provide an image forming apparatus including an unfixed toner image forming means for forming unfixed toner images and a fixing means for fixing on a recording material the unfixed toner images formed by the unfixed toner image forming means, in which the fixing means includes a fixing member, a back up member in contact with the fixing member, and a magnetic flux generating means for generating magnetic flux, an eddy is generated in the fixing member by a magnetic flux from the magnetic flux generating means and the fixing means generates heat, the recording material bearing the unfixed toner image is nipped and conveyed at the contact portion between the fixing member and the back up member, thereby the unfixed toner image is fixed on the recording material, the toner of the unfixed toner image contains a releasing agent in a binder which contains a coloring material ingredient and have a melt index value of 0.5 g or more and 100 g or less in accordance with a Melt Index measuring method, and the average surface pressure at the nip portion is $5.9\times10^4$ Pa or more and $24.5\times10^4$ Pa or less.

The foregoing and other objects of the present invention will become more apparent from the following detailed description of the preferred embodiments of the present invention with reference to the drawings.

DETAILED DESCRIPTION OF THE PREFERRED EMBODIMENTS

In the following the preferred embodiments of the present invention will be described with reference to the accompanying drawings.

Figure 1:
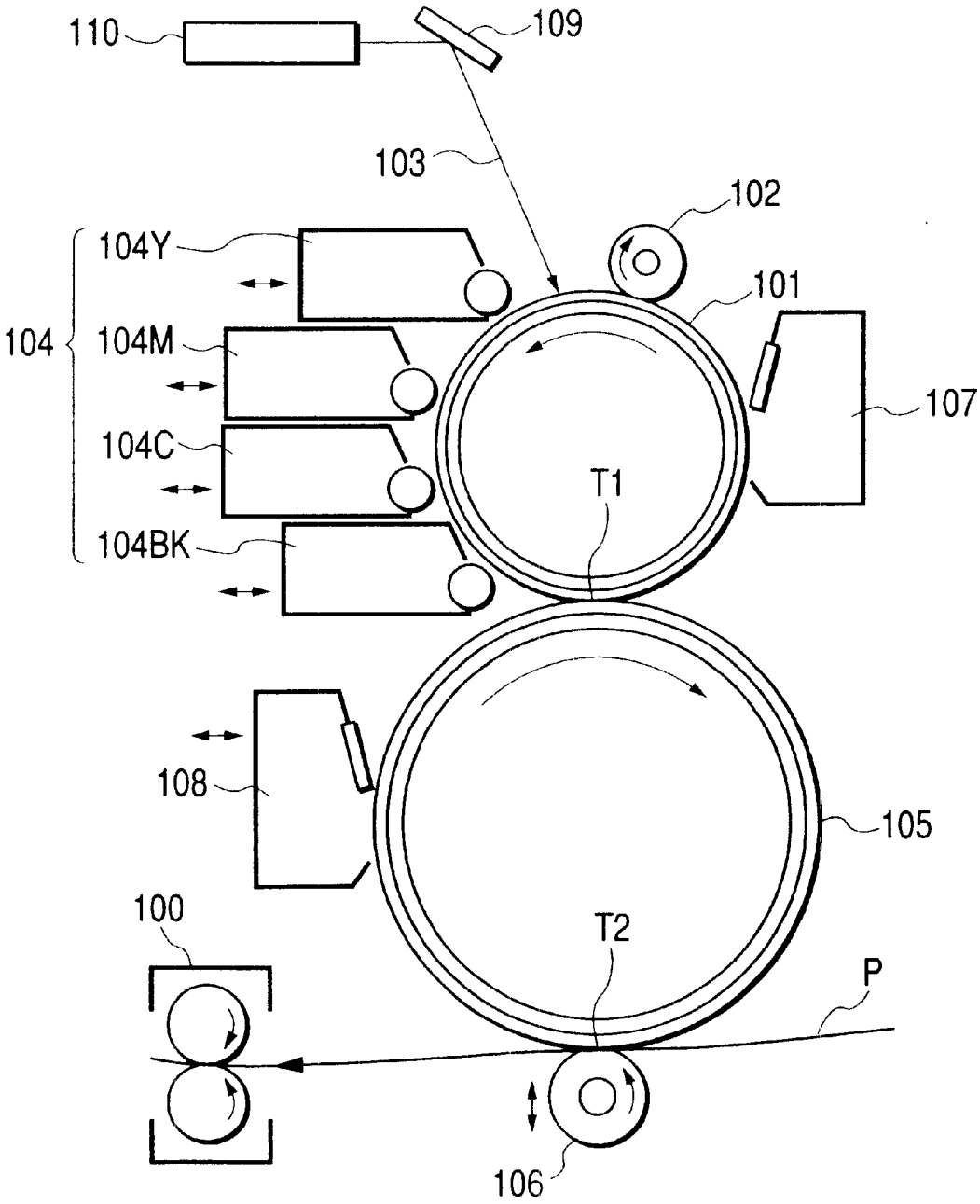
FIG. 1 is a view showing a color image forming apparatus in accordance with one embodiment of the present invention.

Referring first to FIG. 1, there is shown a schematic view of the construction of one example of color image forming apparatus embodying the present invention. This embodiment is a color laser printer.

Reference numeral 101 denotes a photosensitive drum (image bearing body) consisting of an organic photosensitive body or an amorphous silicon photosensitive body, which is rotatively driven at a fixed process speed (peripheral speed) in the counterclockwise direction shown by an arrow.

The photosensitive drum 101 is subjected to charging processing by a charging apparatus 102, such as a charging roller, to have a predetermined polarity and uniform potential.

The surface of the photosensitive drum 101 having been subjected to charging processing is then subjected to scanning exposure processing by a laser beam 103 output from a laser optical box (laser scanner) 110 for the object image information. The laser optical box 110 outputs a laser beam 103 having been modulated (on/off) corresponding to time series electric digital pixel signals for the object image information generated from an image signal generating apparatus, such as an image reader, not shown in the figure, so as to form an electrostatic latent image corresponding to the object image information having been subjected to scanning exposure on the photosensitive drum 101. Reference numeral 109 denotes a mirror for deflecting the laser beam 103 output from the laser optical box 110 toward the exposure position of the photosensitive drum 101.

In forming full color images, a first color separation component image, for example, a yellow component image is subjected to scanning exposure as well as latent image formation, and the formed latent image is developed as a yellow toner image by the operation of a yellow developing device 104Y of four-color developing apparatus 104. The yellow toner image is transferred to the surface of an intermediate transfer drum 105 at a primary transfer portion T1 which is a contact portion (or proximate portion) of the photosensitive drum 101 with the intermediate transfer drum 105. The surface of the photosensitive drum 101 is cleaned by removing residues, such as the residual transferring toner, adhering thereto with a cleaner 107 after the completion of transferring the toner image to the surface of the intermediate transfer drum 105.

A process cycle of charge, scanning exposure, development, primary transfer and cleaning, as described above, is executed in sequence for a second color separation component image (for example, a magenta component image, a magenta developing device 104M operates), a third color separation component image (for example, a cyan component image, a cyan developing device 104C operates) and a fourth color separation component image (for example, a black component image, a black developing device 104 BK operates) of the object full color image, and the four color toner images of yellow, magenta, cyan and black are transferred to the surface of the intermediate transfer drum 105 in such a manner as to be superimposed so as to form a color toner image corresponding to the object full color image.

The intermediate transfer drum 105 consists of a metal drum with a medium-resistant elastic layer and a high-resistant surface layer provided thereon and is rotatively driven at almost the same speed as the photosensitive drum 101 in the clockwise direction shown by an arrow in state where it is in contact with or proximate to the photosensitive drum 101. A toner image on the side of the photosensitive drum 101 is transferred to the surface of the intermediate transfer drum 105 by applying a bias potential to the metal drum of the intermediate transfer drum 105 to produce a potential difference between the two drums.

The above color toner image formed on the surface of the intermediate transfer drum 105 is then transferred at a secondary transfer portion T2, which is a contact and nip portion of the above intermediate transfer drum 105 and a transfer roller 106, to the surface of a recording material (hereinafter referred to as transferring material or paper) P sent from a paper feeder portion not shown in the figure to the secondary transfer portion T2 with a prescribed timing. The transfer roller 106 serves to transfer the composite color toner image on the intermediate transfer drum 105 side to the transfer material P side in sequence and collectively by supplying electric charge having a polarity opposite to that of the toners to the back side of the transfer material P. The photosensitive drum 101, the charging apparatus 102, the developing apparatus 104, the intermediate transfer drum 105, the transfer roller 106, the laser scanner 110, etc. constitute an unfixed toner image forming means.

The transfer material P having passed through the secondary transfer portion T2 is separated from the surface of the intermediate transfer drum 105 and introduced into a fixing apparatus (image heating apparatus) 100, where the unfixed toner image is subjected to heat fixing processing, and discharged to feeder output tray, not shown in the figure, out of the apparatus.

The intermediate transfer drum 105 is cleaned by removing the residues, such as the residual transferring toners and paper dust, adhering thereto with a cleaner 108 after the completion of transferring the color toner image to the transferring material P.

Normally the cleaner 108 is held out of contact with the intermediate transfer drum 105, but it is held in contact with the same during the process of executing the secondary transfer of the color toner image from the intermediate transfer drum 105 to the transfer material P.

Normally the transfer roller 106 is also held out of contact with the intermediate transfer drum 105, but it is held in contact with the same via the transfer material P during the process of executing the secondary transfer of the color toner image from the intermediate transfer drum 105 to the transfer material P.

The apparatus in accordance with this embodiment can call a monochromatic printing mode, that is, a black and white printing mode as well as a double-side printing mode into execution.

When the apparatus is in the double-side printing mode, the transfer material P having come out of the fixing apparatus 100 with its first side having been subjected to image printing is sent again to the secondary transfer portion T2 via a circulating conveying mechanism not shown in the figure, in which it is reversed front side back so that its second side is subjected to toner image transfer, and is introduced again into the fixing apparatus 100 so that the toner image on the second side is subjected to fixing processing, thereby a double-side print is output.

In order to make possible oilless fixing, the toners used in a color image forming apparatus of the present invention contain wax, as a releasing agent, in their binder which contains a coloring material ingredient and their melt viscosity are set at a MI value (melt index value) in the range of 0.5 g to 100 g in accordance with the Melt Index measuring method, as described above. Now the toners will be described.

Preferably used are non-magnetic single-component fine particle toners which contain a binder resin, a coloring agent, a charge control agent and a material with a low softening point.

a) Binder Resin

Binder resins in common use for color toners can be used, and they include, for example, styrene-based copolymers such as styrene-polyester and styrene-butyl acrylate copolymers; polyester resins; and epoxy resins.

b) Coloring Agent

Coloring agents in common use for color toners can be used, and those for use in a yellow toner include, for example, benzine yellow pigments, phorone yellow, insoluble acetoacetic anilide azo pigments, monoazo dye, and azo methine coloring material.

Coloring agents for use in a magenta toner include, for example, phosphotungstomolybdic acid lake which is a xanthene magenta dye, 2,9-dimethylquinacridone, insoluble naphthol azo pigments, anthraquinone dyes, coloring material consisting of xanthene dyes and organic carboxylic acid, and thioindigo.

Coloring agents for use in a cyan toner include, for example, copper phthalocyanine pigments.

c) Charge Control Agent

Charge control agents in common use for color toners can be used, and negative charge control agents include, for example, metal complexes of alkylsalicylic acid, metal complexes of dicarboxylic acid, and polycyclic metal salts of salicylic acid. Positive charge control agents include, for example, quaternary ammonium salts, derivatives of benzothiazole, derivatives of guanamine, dibutyltin oxide, and other nitrogen-containing compounds.

d) Low Softening Point Material

Low softening point materials include, for example, paraffin wax, polyolefin wax, microcrystalline wax, polymethylene wax such as Fischer-Tropsch wax, amide wax, higher fatty acids, long-chain alcohols, ester wax, and the derivatives, such as graft and block compounds, thereof. The content of low softening point material is preferably 5 to 30% by weight per 100% by weight toner.

The toners are preferably polymerized toners obtained by the polymerization method which produces toner particles by polymerizing polymeric monomer compositions containing polymeric monomers, coloring agents, charge control agents and low softening point materials, and more preferably polymerized toners obtained by polymerizing polymeric monomer compositions in a liquid medium, for the polymerized toners thus obtained can be spherical.

Particularly suspension polymerized toners obtained by the suspension polymerization of polymeric monomer compositions in a water-based medium are preferably used, because the toner particles are allowed to contain wax as a low softening point material in the water-based medium using the difference in polarity among the ingredients contained in the polymeric monomer compositions.

And preferably used are non-magnetic single-component fine particle polymerized toners of which shape factor SF1 is 100 to 140, preferably 100 to 120, shape factor SF2 is 100 to 120, weight average particle diameter is 5 to 7 $\mu$m, and shape is substantially spherical.

Figure 2A:
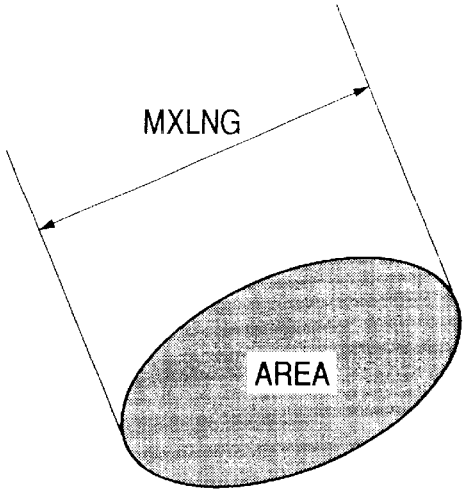
FIGS. 2A and 2B are views illustrating shape factors of toners SF1 and SF2, respectively.

The terms "shape factor SF1" herein used is a value indicating the percentage of the roundness of spherical matter, which is obtained by dividing the square of the maximum length MXLNG of the elliptical figure formed by projecting the spherical matter on a two-dimensional plane by the area AREA of the figure and multiplyng the result by 100 $\pi/4$, as shown in FIG. 2A. In short, the shape factor SF1 is defined by the following equation:

$$SF1=\{(MXLNG)^2/AREA\}\times(100\ \pi/4)$$

The larger the value of SF1 becomes, the more indefinite the shape of the spherical matter becomes. If the value SF1 is too large, the spherical matter loses its properties accompanying its spherical shape, the performance of field cleaning may be weakened.

Figure 2B:
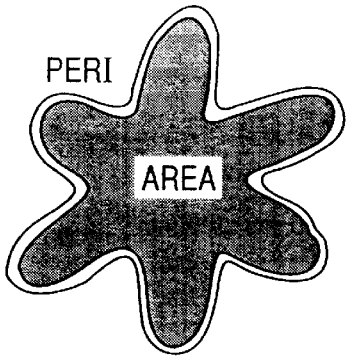

The terms "shape factor SF2" herein used is a value indicating the percentage of the irregularities of matter, which is obtained by dividing the square of the peripheral length PERI of the figure formed by projecting the matter on a two-dimensional plane by the area AREA of the figure and multiplying the result by $100/4\pi$, as shown in FIG. 2B. In short, the shape factor SF2 is defined by the following equation:

$$SF2=\{(PERI)^2/AREA\}\times(100/4\pi)$$

The larger the value of SF2 becomes, the more remarkable the irregularities of the surface of the matter become.

In this embodiment, random sampling of toner images was performed 100 times using FE-SEM (S-800) manufactured by Hitachi, Ltd., the image information was introduced into an image analyzer (LUSEX3) manufactured by Nireco, Inc. to be analyzed, and the shape factors SF1 and SF2 were calculated using the above equations.

It is said that if the shape of toners becomes infinitely like spherical shape, transfer efficiency increases. The reason may be that the surface energy of each individual toner becomes low, the flow property of the toners is increased, the adsorptivity (mirroring force) of the toners on the photosensitive drum decreases, accordingly the toners become susceptible to transfer field.

The particle size distribution of toners can be measured by, for example, the following method. It can be measured using Coulter Counter TA-II or Coulter Multi-sizer (manufactured by Coulter, Inc.). As an electrolysis solution, 1% NaCl aqueous solution is prepared using the first grade sodium chloride. For example, ISOTONR-II (manufactured by Coulter Scientific Japan) may be usable.

The process of measuring is as follows. First, a surfactant as a dispersing agent, preferably 0.1 to 5 ml of alkylbenzensufonate is added to 100 to 150 ml of the above electrolysis solution, then 2 to 20 mg of measuring sample is added. The electrolysis solution with the sample suspended therein is subjected to dispersion processing with an ultrasonic disperser for about 1 to 3 minutes, then the volume and number of the toner 2 $\mu$m or more in diameter are measured with the above measuring apparatus using 100 $\mu$m aperture, so as to calculate the volume distribution and the number distribution. Weight average particle diameter ($D_4$) can be obtained on the basis of the weight calculated from the volume distribution of the toners (a representative value of each channel is used as the representative value for each channel).

As channels, used are 13 channels of, for example, 2.00 to less than 2.52 μm, 2.52 to less than 3.17 μm, 3.17 to less than 4.00 μm, 4.00 to less than 5.04 μm, 5.04 to less than 6.35 μm, 6.35 to less than 8.00 μm, 8.00 to less than 10.08 μm, 10.08 to less than 12.70 μm, 12.70 to less than 16.00 μm, 16.00 to less than 20.20 μm, 20.20 to less than 25.40 μm, 25.40 to less than 32.00 μm, and 32.00 to less than 40.30 μm.

Figure 3:
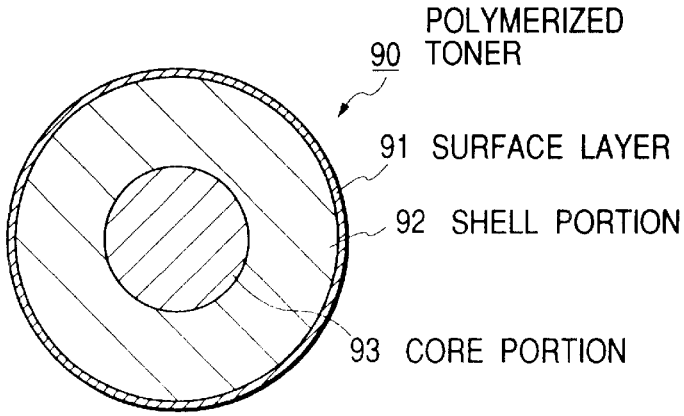
FIG. 3 is a cross-sectional view of a polymerized toner.

FIG. 3 is a schematic view in section showing one embodiment of the above polymerized toner particle. The shape of the polymerized toner 90 is spherical. The toner particle has a core 93/shell 92 structure, and the main ingredient of the core portion 93 of the core/shell structure is a low softening point material. Preferably the low softening point material has a melting point of 40 to 120° C. For example, a polymerized toner can be usable which consists of the core 93 containing ester wax, which is a low softening point material, as a main ingredient, the shell portion 92 of styrene-butyl acrylate resin layer, and the surface layer 91 of styrene-polyester.

With such a polymerized toner, offsets during the fixing process can be effectively prevented because it has 3-layer structure and contains wax in the core 93, and moreover, charging can be performed much more efficiently because it has a resin layer provided as the surface layer 91. When actually using such a toner, oil-treated silica can be added so as to stabilize triboelectricity.

Further, other additives:

- lubricant powders such as Teflon, zinc stearate, and polyvinylidene fluoride powders;
- abrasives such as cerium oxide, silicon carbide and strontium titanate powders;
- flow property imparting agents such as silica, titanium oxide and aluminium oxide powders, and the same powders having been subjected to silane coupling agent and/or silicone oil treatment;
- anti-caking agents;
- conductivity imparting agents such as carbon black, zinc oxide and tin oxide powders; and
- development improvers such as organic and inorganic fine particles with opposite polarity to the toner can also be used within the limit of not substantially affecting the toner.

One example of methods of producing a polymerized toner is as follows.

First a releasing agent, a coloring agent, a charge control agent, a polymerization initiator and other additives are added to and uniformly dissolved or dispersed in a polymeric monomer with a mixing machine such as homogenizer and ultrasonic disperser, so as to obtain a monomer composition, then the monomer composition is dispersed in a water phase containing a dispersion stabilizer with a disperser such as homomixer. At the stage in which the droplets of the monomer composition have a desired toner particle size, the granulation is stopped. After this, the liquid mixture should be agitated only to a degree that the particle state of the monomer composition can be maintained by the action of the dispersion stabilizer and the particles can be prevented from settling.

The polymerization is performed at 40° C. or higher, generally at a set temperature of 50 to 90° C. The temperature may be raised in the latter half of the polymerization reaction so as to control the molecular weight distribution, in addition, part of water-based medium may be removed by distillation in the latter half of the reaction or after the reaction so as to remove unreacted polymeric monomer and by-product. After the completion of the reaction, the produced toner particles are collected through cleaning and filtration and dried. In the suspension polymerization method, generally and preferably 300 to 3000 parts by weight of water is used as a dispersion medium per 100 parts by weight of monomer composition.

In the above production method, if the toner is allowed to have the melting viscosity of a MI value of 0.5 g to 100 g in accordance with the Melt Index measuring method (a larger MI value means a lower viscosity), images of good visibility, which are satisfactory in terms of offset during the fixing operation and of which glossiness is not too high, can be obtained all for documents, graphics and photos.

The above MI value was measured with Semiautomatic 2-A Melt Indexer manufactured by Tokyo Seiki under the following conditions: 2 mm orifice, 5 kg load, heat chamber at 125° C., and for 10 minutes.

If the above MI value is more than 100 g, the glossiness of images increases, and moreover, with the increase in MI value, offsets during the fixing operation at high temperatures become worse. If the above MI value is less than 0.5 g, toners are hard to fix.

Figure 4:
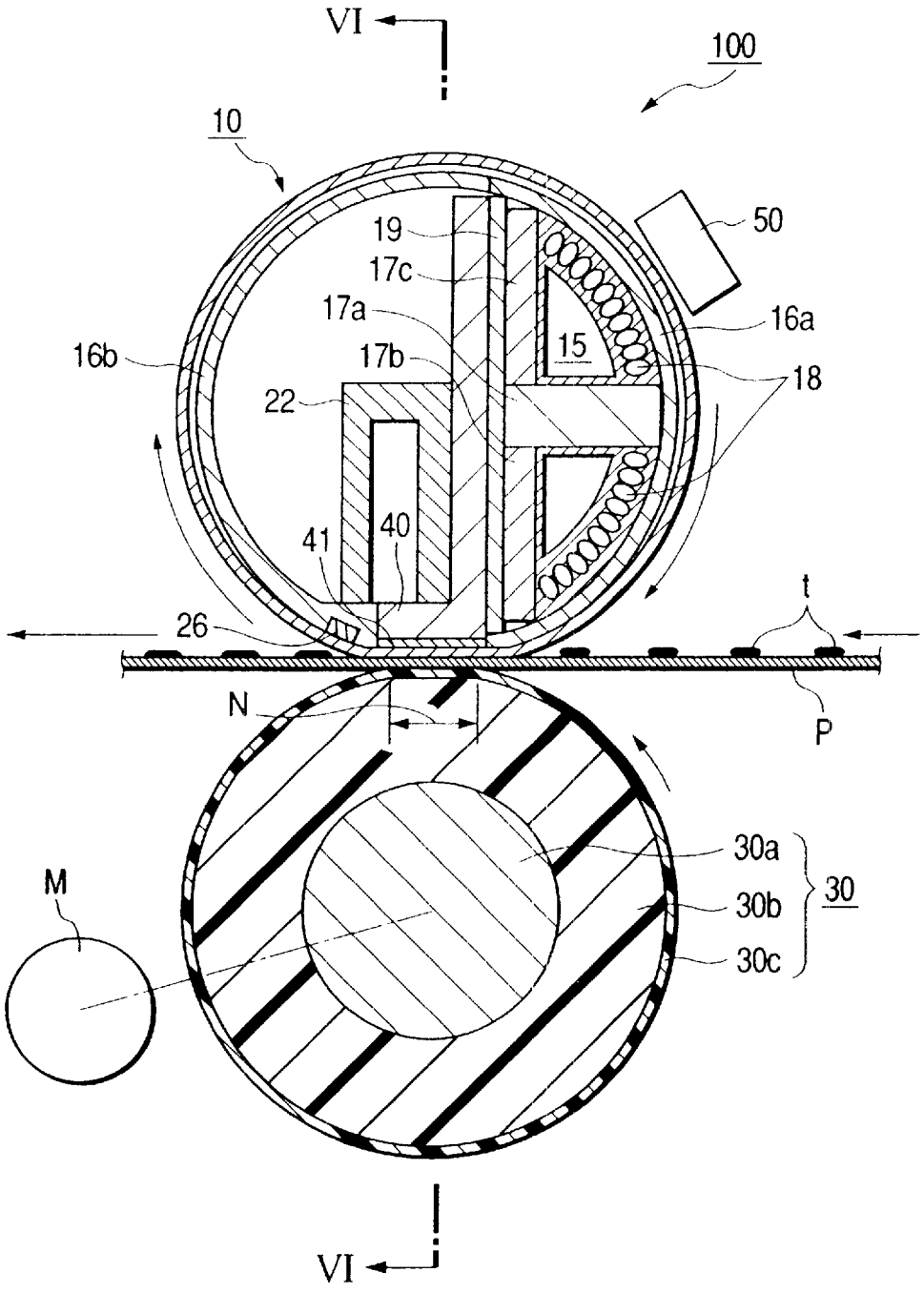
FIG. 4 is a cross-sectional side elevation of a fixing apparatus having been applied to an image forming apparatus in accordance with one embodiment of the present invention.
Figure 5:
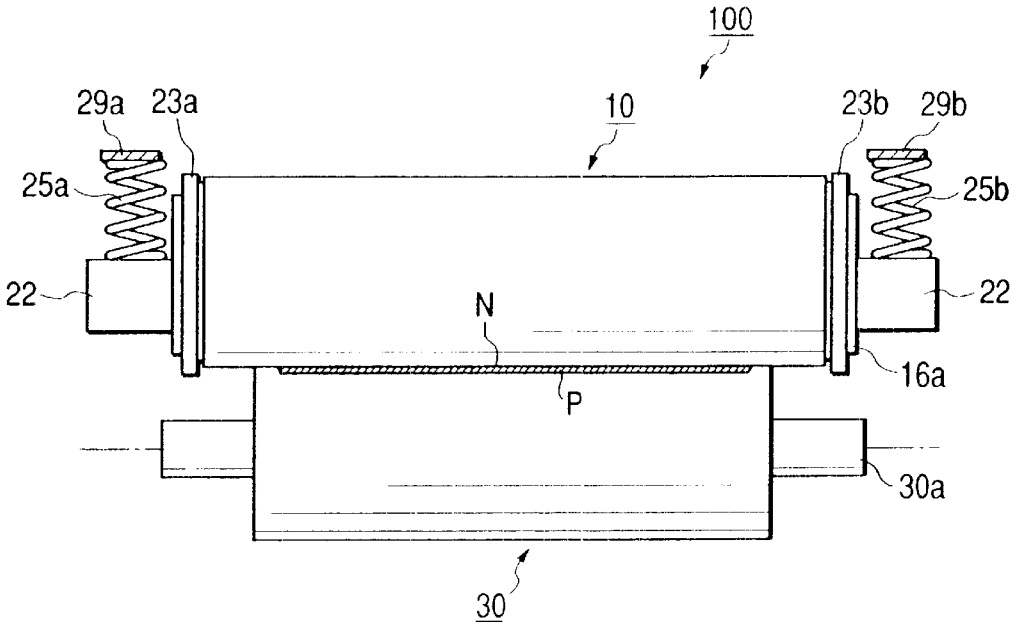
FIG. 5 is a front view of the apparatus shown in FIG. 4.
Figure 6:
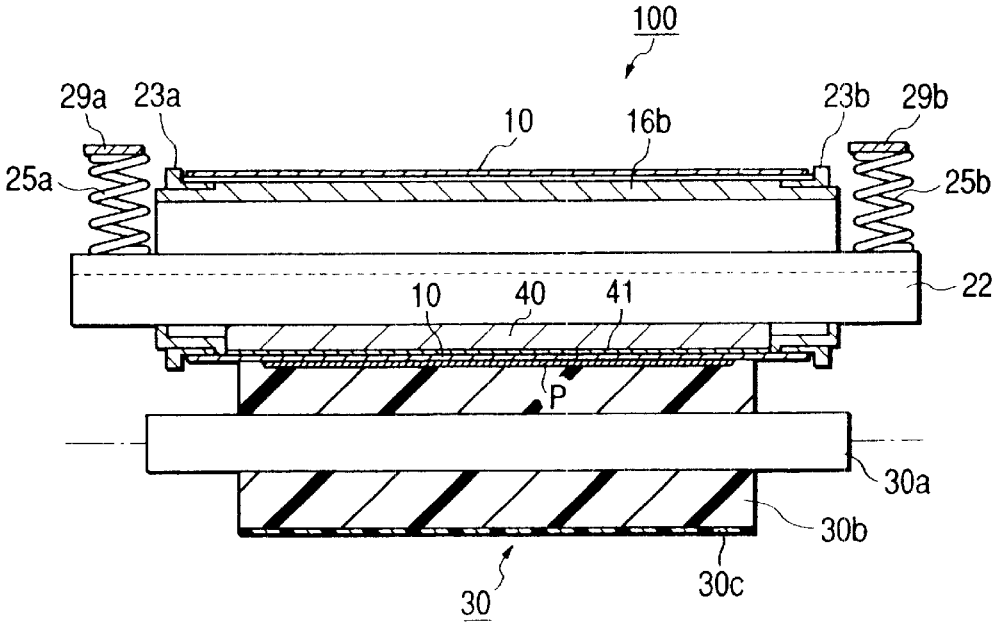
FIG. 6 is a front vertical sectional view of the apparatus shown in FIG. 4.

In this embodiment, a fixing apparatus 100 is an apparatus adopting the electromagnetic induction film heating fixing method. FIG. 4 is a schematic view in section showing the main part of the fixing apparatus 100, FIG. 5 a front view showing the main part of the same, and FIG. 6 a front vertical sectional view of the main part of the same.

Figure 16:
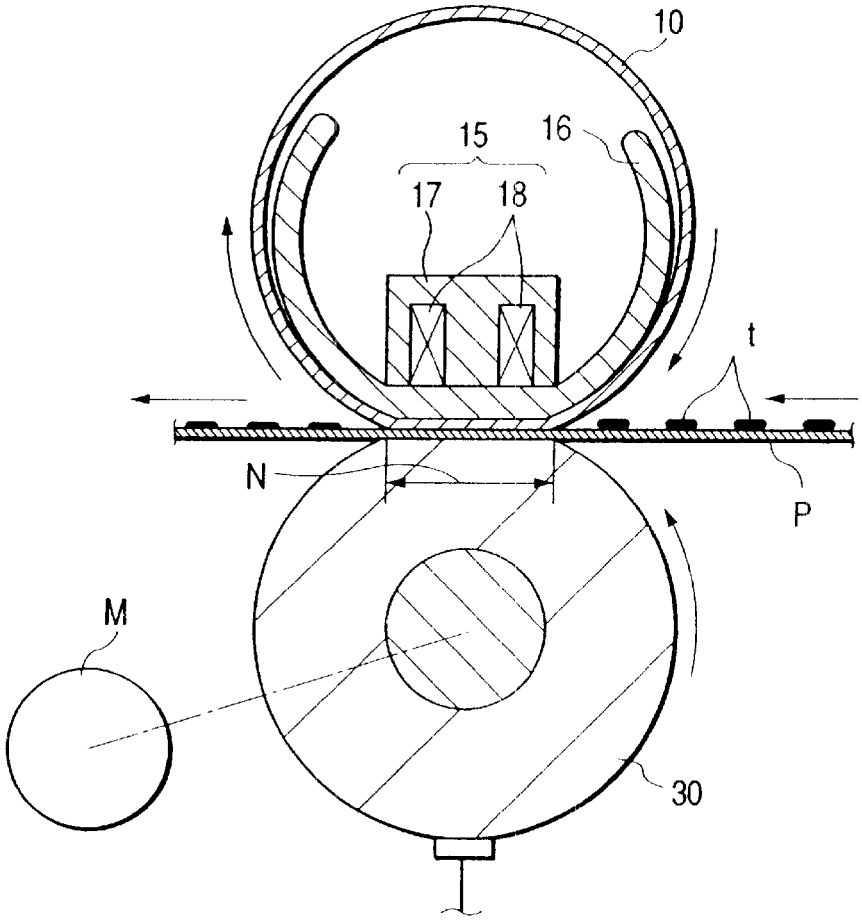
FIG. 16 PRIOR ART
FIG. 16 is a cross-sectional side elevation of a fixing apparatus of a prior art.
Figure 17:
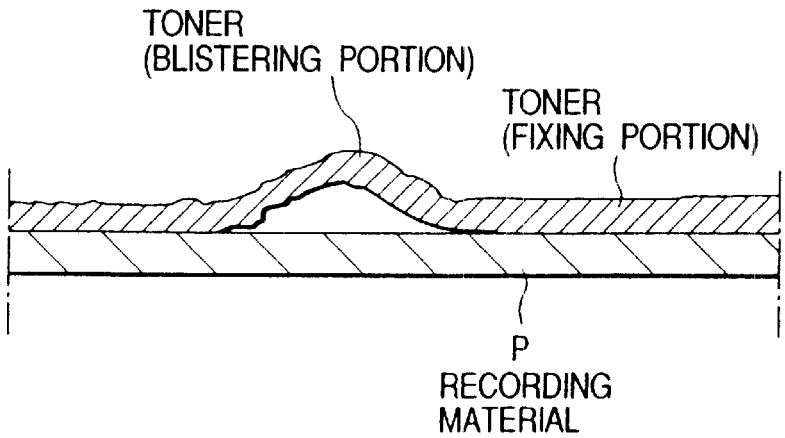
FIG. 17 PRIOR ART
FIG. 17 is a view showing blistering portion of a fixed toner image.

The apparatus 100 of this embodiment adopts the pressurizing roller driving method as well as the electromagnetic induction film heating fixing method and uses a cylindrical electromagnetic induction heat generating film (cylindrical rotational body) as the fixing member, like the fixing apparatus shown in FIG. 16. The same constituents and portions as those of the apparatus of FIG. 16 are denoted by the same reference numerals and the description thereof shall be omitted.

A magnetic field generating means (magnetic flux generating means) 15 consists of magnetic cores 17*a*, 17*b* and 17*c* and excitation coils 18.

The magnetic cores 17*a*, 17*b* and 17*c* are highly permeable members, and as the materials, those used for the cores of transformers, such as ferrite and permalloy, are preferably used, and more preferably used is ferrite of which loss is small even at 100 kHz or more.

Figure 7:
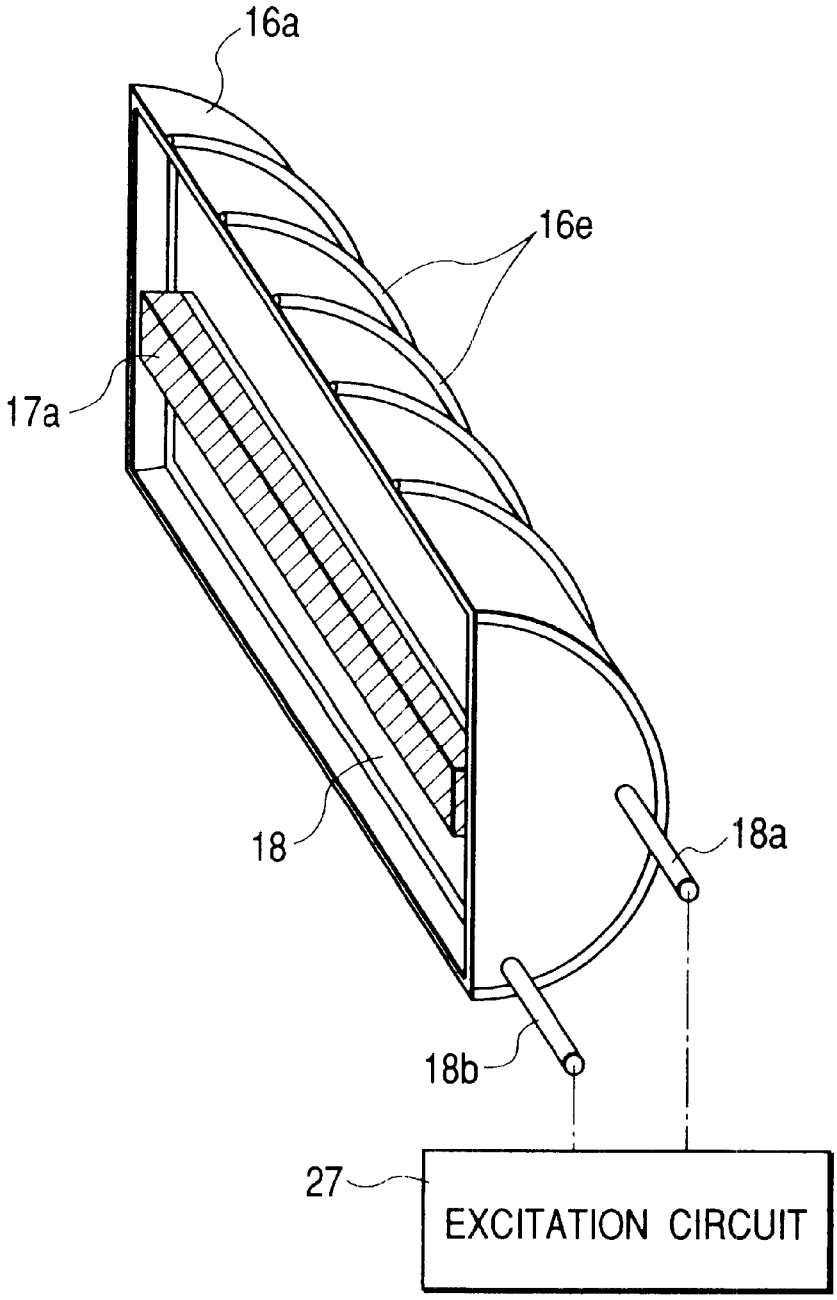
FIG. 7 is a perspective view of a magnetic field generating means.

An excitation circuit 27 is connected to feeding portions 18*a*, 18*b* of the excitation coils 18 (FIG. 7). This excitation circuit 27 is allowed to generate high frequency of 20 kHz to 500 kHz with a switching power supply.

The excitation coil 18 generates alternating flux by the supply of alternating current from the excitation circuit 27.

Reference numerals 16*a* and 16*b* denote gutter-shaped film guide members of which cross section is almost semicircular. They constitute an almost cylindrical body with their open sides facing each other and a fixing film 10, which is a cylindrical electromagnetic induction heat generating film, is loose fitted on the outside thereof.

The above film guide member 16*a* holds the magnetic cores 17*a*, 17*b* and 17*c* and excitation coils 18, as a magnetic field generating means 15.

A highly heat conductive member 40 is placed on the film guide member 16*a* on the side of a fixing nip portion N facing a pressuring roller 30 and inside the fixing film 10 and functions as a back up member for backing up the inside of the fixing film.

In this embodiment, aluminum 1 mm thick was used for the highly heat conductive member 40.

The highly heat conductive member 40 is placed outside the magnetic field generated by the excitation coils 18 and magnetic cores 17*a*, 17*b* and 17*c*, as a magnetic field generating means, so that it should not be affected by the magnetic field.

Specifically, the highly heat conductive member 40 is placed in such a place as is separated from the excitation coil 18 by a magnetic core 17*c*, that is, outside the magnetic path generated by the excitation coil 18, so that the highly heat conductive member 40 is not affected by the magnetic field.

Reference numeral 22 denotes a transverse rigid pressurizing stay placed in such a manner as to come in contact with the opposite side of the portion of the highly heat conductive member 40 which faces the nip portion N and with the internal plane portion of the film guide member 16*b*.

Reference numeral 19 denotes an insulating member for insulating the rigid pressurizing stay 22 from the magnetic cores 17*a*, 17*b*, 17*c* and the excitation coils 18.

Flange members 23*a*, 23*b* are fitted on both right and left end portions of the assembly of the film guide members 16*a*, 16*b*. They are rotatably attached while being fixed at the above right and left position and serve to regulate the skew movement of the fixing film 10 longitudinally along the film members by receiving the end portions of the fixing film during the rotation thereof.

A pressurizing roller 30 as a pressurizing member, which is another back up member, consists of a core bar 30*a*, a heat-resistant elastic material layer 30*b* of silicone rubber, fluororubber, fluororesin, etc. which is formed in the form of a roller coaxially around the above core bar in such a manner as to coat the same, and a releasing layer 30*c* as a surface layer, which is a fluororesin layer (about 10 $\mu$m to 100 $\mu$m thick) of PFA, PTFE, FEP, etc. and it is placed in such a manner that both end portions of its core bar 30*a* is freely rotatably held with a bearing between the side plates of a chassis of the apparatus not shown in the figure.

A press-down force is applied to the rigid pressurizing stay 22 by placing springs 25*a*, 25*b* in a compressed state between both end portions of the rigid pressurizing stay 22 and spring receiving members 29*a*, 29*b* on the chassis of the apparatus, respectively. This allows the bottom surface of the portion, which corresponds to the nip portion N, of the highly heat conductive member 40 and the top surface of the pressurizing roller 30 to come in press contact with each other via the fixing film 10, so as to form the fixing nip portion N with a predetermined width.

In order to ensure a certain width of the nip N, it is not preferable that the hardness of the pressurizing roller 30 is too high. Desirably the hardness of the pressurizing roller 30 ranges between the lower limit of about 45 degrees (Asker C hardness measured from the surface layer of the pressurizing roller, 1 kg load), in terms of mechanical strength, and the upper limit of 75 degrees, in terms of ensuring a certain nip.

The pressurizing roller 30 is rotatively driven by a driving means M in the counterclockwise direction shown by an arrow. When rotatively driving the pressurizing roller 30, torque acts on the fixing film 10 by the friction force generated between the above pressurizing roller 30 and the external surface of the fixing film 10, consequently, the above fixing film 10 is rotated around the periphery of the film guide members 16*a*, 16*b* at a peripheral speed almost corresponding to that of the pressurizing roller 30 in the clockwise direction shown by an arrow with its internal surface sliding on the bottom surface of the highly heat conductive member 40 at the fixing nip portion N.

In this case, a lubricant such as heat-resistant grease is applied between the bottom surface of the highly heat conductive member 40 and the internal surface of the fixing film 10 at the fixing nip portion N so as to reduce the friction force produced by the mutual sliding between the bottom surface of the highly heat conductive member 40 and the internal surface of the fixing film 10 at the fixing nip portion N. Alternatively, the bottom surface of the highly heat conductive member 40 may be coated with a lubricating member 41. The use of a lubricant or lubricating member prevents the deterioration of durability of the fixing film 10 which may occur when the fixing film 10 is scraped with highly heat conductive member 40 having poor surface slidability due to its material, for example aluminum, or due to the simplification of the finish machining.

The highly heat conductive member 40 is effective in making the longitudinal temperature distribution uniform; for example, when passing small size paper, as a transferring material (recording material) P, through the fixing apparatus, the quantity of heat at the non-paper-passing portion of the fixing film 10 is transferred to the highly heat conductive member 40, and due to the longitudinal heat transfer at the highly heat conductive member 40, the quantity of heat at the non-paper-passing portion is transferred to the small size paper passing portion. This also produces an effect on decreasing the power consumption during the small size paper passing.

As shown in FIG. 7, convex rib portions 16*e* are formed and spaced longitudinally at fixed intervals on the peripheral surface of the film guide member 16*a*, thereby reducing the contact and slide resistance between the periphery surface of the film guide member 16*a* and the internal surface of the fixing film 10, so as to decrease the rotation load of the fixing film 10. Such convex rib portions 16*e* can also be formed and provided on the film guide member 16*b*.

Figure 8:
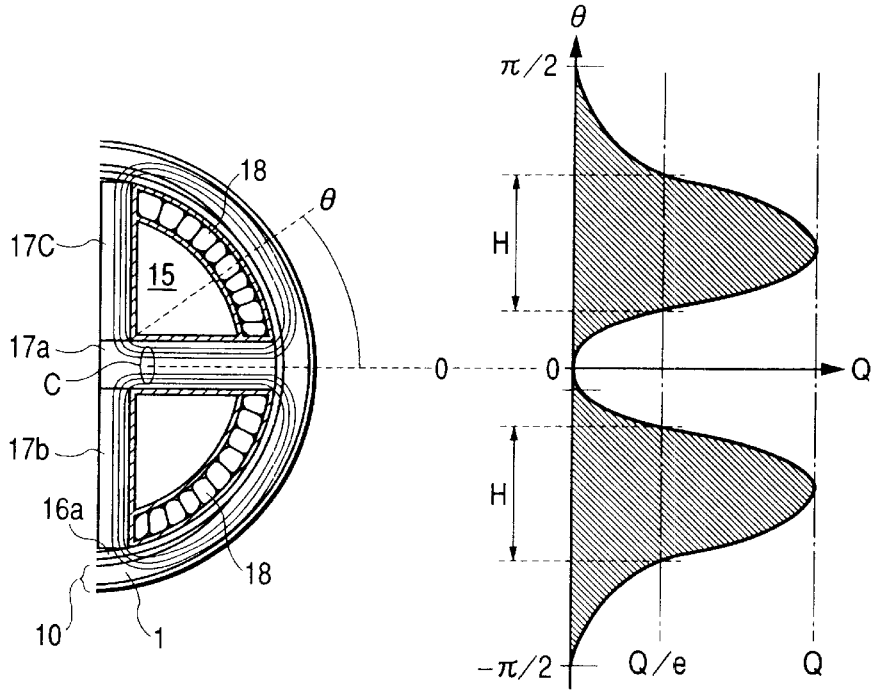
FIG. 8 is a view showing the state in which alternating magnetic flux is generated.

FIG. 8 is a schematic view showing the state where alternating magnetic flux is generated. Magnetic flux C shows part of the alternating magnetic flux generated.

The alternating magnetic flux C introduced to the magnetic cores 17*a*, 17*b*, 17*c* induces an eddy current in the electromagnetic induction heat generating layer 1 of the fixing film 10 between the two magnetic cores 17*a* and 17*b* and between the two magnetic cores 17*a* and 17*c*. This eddy current produces Joule heat (eddy current loss) in the electromagnetic induction heat generating layer 1 due to the resistivity thereof.

The quantity of generated heat Q depends on the density of the magnetic flux passing through the electromagnetic induction heat generating layer 1 and its distribution is shown by the graphical representation of FIG. 8. In the graph of FIG. 8, the circumferential position of the fixing film 10 expressed by an angle θ, where 0 is the center of the magnetic core 17*a*, is plotted in vertical axis and the quantity of generated heat Q in the electromagnetic induction heat generating layer 1 of the fixing film 10 is plotted in horizontal axis. The heat generating area H is defined as area in which the quantity of generated heat is Q/e or more where Q is the maximum generated heat. This area means an area in which the required quantity of generated heat is obtained.

The temperature of the fixing nip portion N is controlled by controlling the current supply to the excitation coils 18 with a temperature controlling system including a temperature detecting means 26 (FIG. 4) so as to keep the portion at a predetermined temperature.

The temperature detecting means 26 is a temperature sensor such as thermister for detecting the temperature of the fixing film 10, and in this embodiment the temperature of the fixing nip portion N is controlled based on the temperature information of the fixing film 10 measured with this temperature sensor 26.

Thus, in state where the fixing film 10 is rotated, the electromagnetic induction heat generation is caused in the fixing film 10 in such a manner as described above by the feeding from the excitation circuit 27 to the excitation coils 18, and the fixing nip portion N is heated to a fixed temperature and the temperature is being controlled, a transferring material P, which is conveyed from the portion of an image forming means and has an unfixed toner image t formed thereon, is introduced between the fixing film 10 and the pressurizing roller 30 at the fixing nip portion N with the image side facing up, that is, with the image side facing the surface of the fixing film. At the fixing nip portion N, the image side closely touches the external surface of the fixing film 10, thus the transferring material is conveyed together with the fixing film 10 through the fixing nip portion N while being nipped between the fixing film 10 and the pressurizing roller 30.

During the process of being conveyed together with the fixing film 10 through the fixing nip portion N while being nipped between the fixing film 10 and the pressurizing roller 30, the transferring material P is heated due to the electromagnetic induction heat generation of the fixing film 10, and the unfixed toner image t is heat fixed on the transferring material P.

The transferring material P having passed through the fixing nip portion N is separated from the external surface of the fixing film 10 and conveyed to be discharged.

After passing through the fixing nip portion, the heat fixed toner image on the transferring material P is cooled to become a permanent fixed image.

In this embodiment, as shown in FIG. 4, a thermoswitch 50 as a temperature detecting element is placed in the position facing the heat generating area H (FIG. 8) of the fixing film 10 in order to break feed to the excitation coils 18 when crush occurs.

Figure 9:
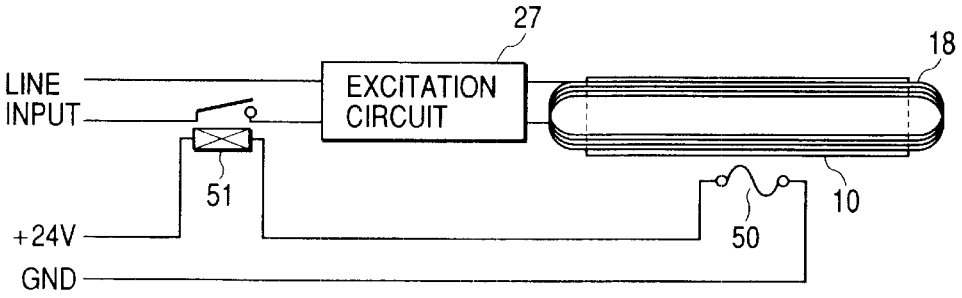
FIG. 9 is a safety circuit diagram.

FIG. 9 is a diagram of the safety circuit used in this embodiment. The safety circuit is constructed as follows: the thermoswitch 50 as a temperature detecting element is in connection with 24V DC source and a relay switch 51 in series, and when the thermoswitch 50 is turned off, the feed to the relay switch 51 is quickly broken and the relay switch 51 operates, then the feed to the excitation circuit 27 is quickly broken, the feed to the excitation coils 18 is thereby broken. The OFF operation temperature of the thermoswitch 50 was set at 220° C.

The thermoswitch 50 was placed in such a manner as to face the heat generating area H of the fixing film 10 and be out of contact with the external surface of the fixing film 10. The spacing between the thermoswitch 50 and the fixing film 10 was about 2 mm. With this spacing, the fixing film 10 is never scraped by the contact with the thermoswitch 50, and the deterioration of the fixed image after long duration can be prevented.

For the fixing apparatus of this embodiment, when the apparatus crushes due to its failure, and even when the apparatus stops while nipping paper (transferring material) P in the fixing nip portion N and the feed to the excitation coils 18 continues, accordingly, the fixing film 10 continues to generate heat, the fixing nip portion N in which paper is nipped does not generate heat; therefore, the paper is never directly heated, unlike the above described fixing apparatus shown in FIG. 16 in which the fixing nip portion N generates heat. Further, the thermoswitch 50 is provided for the heat generating area H in which a large quantity of heat is generated; therefore, once the thermoswitch 50 detects 220° C., it is turned off and the relay switch 51 breaks the feed to the excitation coils 18.

According to this embodiment, heat generation of the fixing film 10 can be stopped without igniting paper, because the ignition point of paper is about 400° C.

In addition to the thermoswitch 50, a thermal fuse can be used.

In this embodiment, an oil application mechanism for preventing offsets was not provided for the fixing apparatus, because toners containing a low softening point material were used as the toner t.

The excitation coils 18 were formed by using a bundle of more than one copper small-gage wires (wire bundle), each of which was subjected to insulating coating, as a conductor (electric wire) constituting a coil (wire coil) and winding the same into more than one turns of coil. In this embodiment, the excitation coils 18 were formed of 10 turns of the above coil.

As an insulting coating, a heat resistant insulting coating should be used taking into account the heat transfer caused by the heat generation of the fixing film 10. For example, coatings of amide-imide and polyimide should be used.

An external pressure may be applied to the excitation coils 18 so as to improve its density.

The excitation coils 18 were shaped in such a manner as to fit the curved surface of the heat generating layer 1 of the fixing film 10, as shown in FIGS. 4 and 8. In this embodiment, the spacing between the heat generating layer 1 of the fixing film 10 and the excitation coils 18 was set for about 2 mm.

Preferably the materials for the film guide members (excitation coil holding members) 16*a*, 16*b* are excellent in insulating properties and highly heat-resistant. Preferably selected are the materials such as phenolic resin, fluororesine, polyimide resin, polyamide resin, polyamide-imide resin, PEEK resin, PES resin, PPS resin, PFA resin, PTFE resin, FEP resin, and LCP resin.

The smaller the spacing between the magnetic cores 17*a*, 17*b*, 17*c* as well as the excitation coils 18 and the heat generating layer 1 of the fixing film 10, the higher magnetic flux absorption efficiency becomes. If the spacing is more than 5 mm, the efficiency decreases considerably; accordingly, the spacing should be within 5 mm. The spacing between the heat generating layer 1 of the fixing film 10 and the excitation coils 18 should not necessarily be constant as long as the spacing is within 5 mm.

For the extension lines of the excitation coils 18 from the film guide member 16*a*, that is, the feed portions 18*a*, 18*b* (FIG. 7), the outside of the wire bundle out of the film guide member 16*a* was subjected to insulating coating.

Figure 10A:
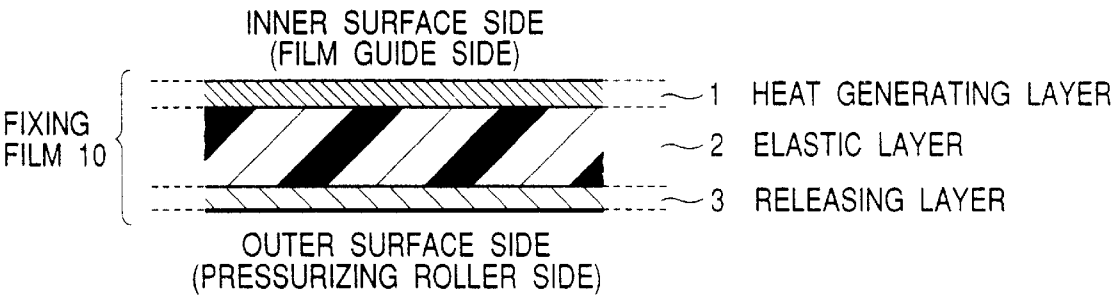
FIGS. 10A and 10B are views showing the layer construction of fixing films.

FIG. 10A is a schematic view showing the layer construction of the fixing film 10 in accordance with this embodiment. The fixing film 10 of this embodiment is a composite structure consisting of a heat generating layer 1, as a base layer of the electromagnetic induction heat generating fixing film 10, formed of metal film etc., an elastic layer 2 stacked on the external surface of the above heat generating layer 1, and a releasing layer 3 stacked on the external surface of the above elastic layer 2.

In order to bond the heat generating layer 1 to the elastic layer 2 and the elastic layer 2 to the releasing layer 3, primer layers (not shown in the figure) may be provided between the above two layers respectively.

In the almost cylindrical fixing film 10, the heat generating layer 1 is provided on the inner surface side and the releasing layer 3 on the outer surface side. As described above, alternating magnetic flux induces an eddy current in the heat generating layer 1, thereby the heat generating layer 1 generates heat. The generated heat heats the fixing film 10 via the elastic layer 2 and the releasing layer 3, thereby the transferring material P, as a material to be heated, passed through the above fixing nip portion N is heated, resulting in heat fixing of toner images.

Preferably ferromagnetic metals such as nickel, iron, ferromagnetic SUS, and nickel-cobalt alloy are used for the heat generating layer 1.

Non-magnetic metals may also be used, however, metals of high flux absorptivity such as nickel, iron, ferromagnetic stainless steel, and nickel-cobalt alloy are more preferably used.

Preferably the thickness of the heat generating layer 1 is larger than the skin depth value obtained from the equation shown below and 200 μm or less. The skin depth σ [mm] is expressed by the following equation:

$$\sigma=503\times(\rho/f\mu)^{1/2}$$

where f [Hz] is frequency of the excitation circuit 27, μ is permeability and ρ [Ωm] is resistivity.

Figure 11:
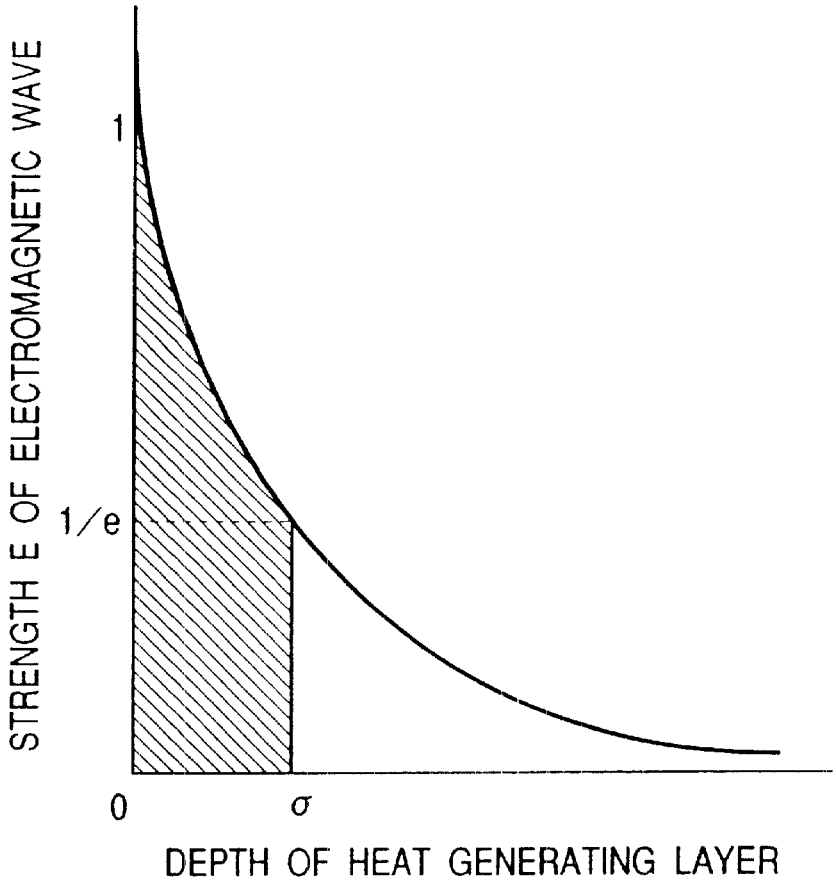
FIG. 11 is a graphical representation showing the relationship between depth of heat generating layer and intensity of electromagnetic wave.

The skin depth indicates the depth of absorbing electromagnetic waves used in electromagnetic induction. At the portion deeper than the skin depth, the intensity of the electromagnetic waves is 1/e or less, in other words, energy is mostly absorbed before the skin depth is reached (FIG. 11).

Preferably the thickness of the heat generating layer 1 is 1 to 100 μm. If the thickness is less than 1 μm, most magnetic energy cannot be absorbed and the efficiency decreases.

On the other hand, if the thickness of the heat generating layer 1 exceeds 100 μm, the rigidity of the layer becomes too high, in addition, the bendability deteriorate; accordingly, it is not realistic to use such a layer for a rotary body. Thus, the thickness of the heat generating layer 1 is preferably determined to be in the range of 1 to 100 μm while taking into account the mechanical strength. In this embodiment, a nickel electrocast product 50 μm thick was used.

For the elastic layer 2, materials excellent in heat resistance and heat conduction, such as silicone rubber, fluororubber and fuluorosilicone rubber, are used.

Figure 12:
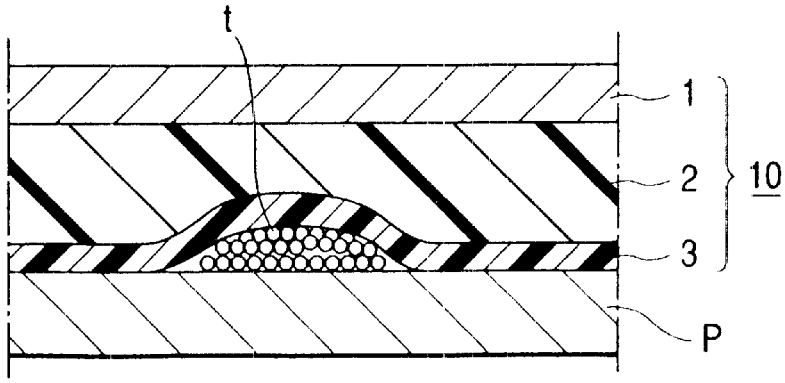
FIG. 12 is a view showing the state in which a toner image is wrapped with the releasing layer of a fixing film.

This elastic layer plays an important part in the prevention of the fine mosaic-like image defect known as "pore", which has been described in the description of the prior arts. Specifically, in the use of the wax-containing toner described above, in order to prevent "pore" from occurring, an effect is needed that the releasing layer 3 as a surface layer of the fixing film 10 reflects the elasticity of the elastic layer 2 and wraps the toner itself (refer to FIG. 12).

Accordingly, the elastic layer 2 is required to be such that its hardness as a simple rubber is 30 degrees or less, more preferably 25 degrees or less in terms of the hardness specified by the JIS-A measurement, that is, by the JIS-K6301 A hardness meter and that its thickness is 50 μm or more, more preferably 100 μm or more.

However, if the thickness of the elastic layer 2 exceeds 500 μm, the heat resistance of the elastic layer becomes too high, and quick start is hard to realize (almost impossible when the thickness is 1000 μm or more). Accordingly, the thickness of the elastic layer 2 is desirably 500 μm or less.

The heat conductivity λ of the elastic layer 2 is preferably $2.5\times10^{-1}$ to $8.4\times10^{-1}$ [W/m/° C.] ($6\times10^{-4}$ to $2\times10^{-3}$ [cal/cm·sec·deg.]).

If the heat conductivity λ is less than $2.5\times10^{-1}$ [W/m/° C.], the heat resistance becomes high, and the temperature increase becomes slow on the surface layer of the fixing film (the releasing layer 3).

If the heat conductivity λ is more than $8.4\times10^{-1}$ [W/m/° C.], the hardness becomes too high, and compression permanent distortion becomes worse.

Accordingly, the heat conductivity λ is preferably $2.5\times10^{-1}$ to $8.4\times10^{-1}$ [W/m/° C.], more preferably $3.3\times10^{-1}$ to $6.3\times10^{-1}$ [W/m/° C.] ($8\times10^{-4}$ to $1.5\times10^{-3}$ [cal/cm·sec·deg.]).

In this embodiment, used was silicone rubber with hardness, as a simple rubber hardness, of 10 degrees (JIS-A), heat conductivity of $4.2\times10^{-1}$ [W/m/° C.] ($1\times10^{-3}$ [cal/cm·sec·deg.]) and thickness of 300 μm.

For the releasing layer 3, materials excellent in releasing tendency and heat resistance such as fluororesin, silicone resin, fluorosilicone rubber, fluororubber, silicone rubber, PFA, PTFE and FEP can be selected. The releasing layer 3 may be a tube layer or resin coating layer of these fluorine-based resins.

In order to allow the surface of the fixing film 10 to fully reflect the elasticity of the elastic layer 2, the thickness of the releasing layer 3 is required to be 100 μm or less at the maximum, more preferably 80 μm or less. If the thickness of the releasing layer 3 is more than 100 μm, the effect that the layer wraps the toner decreases, resulting in the occurrence of "pore" on a solid image.

As the thickness of the elastic layer 2 becomes small, the maximum thickness value of the releasing layer 3 is required to be small. After the intensive examination of the present applicants, it was found that the thickness of the releasing layer 3 is required to be ⅓ or less of that of the elastic layer 2 at the maximum. When the thickness of the releasing layer 3 was more than ⅓ of that of the elastic layer 2, the surface layer of the fixing film 10 did not fully reflect the elasticity of the elastic layer 2.

On the other hand, if the thickness of the releasing layer 3 is less than 5 μm, the mechanical stress applied to the elastic layer cannot be relieved; as a result, the elastic layer and the releasing layer themselves deteriorate. Thus the thickness of the releasing layer 3 is required to be 5 μm or more at the minimum, more preferably 10 μm or more.

In this embodiment, a PFA tube 30 μm thick was used as the releasing layer 3.

The relationships between the thickness of the above elastic layer 2 and that of the releasing layer 3 described so far can be put together to form the following viewpoint: preferably, 50 μm≦t1≦500 μm, 5 μm≦t2≦100 μm, t1≧3×t2 where t1 is the thickness of the elastic layer 2 and t2 is the thickness of the releasing layer 3.

Figure 10B:
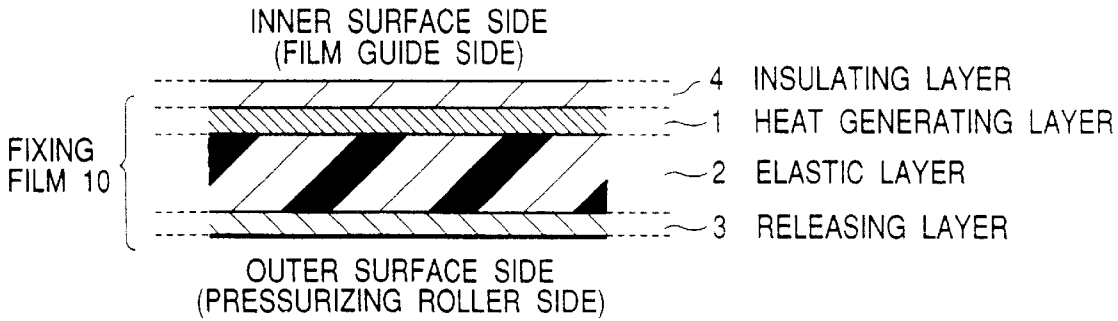

As shown in FIG. 10B, in the construction of the fixing film 10, an insulating layer 4 may be provided on the surface on the film guide member side of the heat generating layer 1 (opposite to the elastic layer 2 side of the heat generating layer 1).

For the insulating layer 4, preferably used are materials of heat-resistant resins such as fluororesin, polyimide resin, polyamide resin, polyamideimide resin, PEEK resin, PES resin, PPS resin, PFA resin, PTFE resin and FEP resin.

The thickness of the insulating layer 4 is preferably 10 to 1000 μm. If the thickness of the insulating layer 4 is less than 10 μm, insulating effect is not produced. In addition, its durability becomes insufficient. On the other hand, if the thickness of the insulating layer 4 exceeds 1000 μm, the spacing between the magnetic cores 17*a*, 17*b*, 17*c* as well as the excitation coils 18 and the heat generating layer 1 becomes large, and magnetic flux is not fully absorbed in the heat generating layer 1.

Since the insulating layer 4 can insulate the heat generated in the heat generating layer 1 so that it should not be transferred to the inside of the fixing film 10, the efficiency of supplying heat to the transferring material P side is high, compared with the fixing film without an insulating layer 4. As a result, power consumption can be reduced.

In order to form a full color image and fix the same on a transferring material with the apparatus constructed as described above, it is necessary to ensure a sufficient heating time in the fixing nip portion N. The faster the fixing speed (conveying speed) of the transferring material becomes, the larger the nip portion is required to be. And when the transferring material passing through the nip portion at a speed of about 100 mm/sec., the nip at least 6 mm or more, preferably 7 mm or more in size is required to ensure. In order to ensure a large size nip, it is generally effective to increase the contact pressure between the fixing film 10 and the pressurizing roller 30; however, when using a wax-containing toner as is in the case of the present invention, a fixing defect in the form of blistering occurs, as described above.

Table-1 shows the state of the fixing defect occurrence at various nip sizes and various average surface pressures at the nip portion. The parameters of the nip size and surface pressure can be changed to predetermined values depending on the hardness or diameter of the pressurizing roller 30, the total contact pressure between the fixing film 10 and the pressurizing roller 30, the width and shape of the pressurizing rigid stay, and the hardness or thickness of the elastic layer 2 of the fixing film 10.

TABLE 1

| Surface Pressure | Nip Size (mm) | | | | |
|---|---|---|---|---|---|
| Pa (Kgf/cm$^2$) | 5 | 6 | 7 | 8 | 9 |
| $5.9 \times 10^4$ (0.6) | x/– | Δ/○ | ○/○ | ○/○ | ○/○ |
| $9.8 \times 10^4$ (1) | x/– | Δ/○ | ○/○ | ○/○ | ○/○ |
| $19.6 \times 10^4$ (2) | x/– | Δ/○ | ○/○ | ○/○ | ○/○ |
| $24.5 \times 10^4$ (2.5) | x/– | Δ/Δ | ○/Δ | ○/Δ | ○/Δ |
| $29.4 \times 10^4$ (3) | x/– | Δ/x | ○/x | ○/x | ○/x |
| $39.2 \times 10^4$ (4) | x/– | Δ/x | ○/x | ○/x | ○/x |

Fixing Characteristics/Blistering:
- ○ Good fixing characteristics, Blistering absent
- Δ Minimum line for practical use
- x Poor fixing characteristics, Blistering present
- – Impossible to evaluate According to Table-1, it is clear that for the fixing characteristics, the evaluation is the minimum limit for practical use when the nip size is 6 mm or more and is good when the nip size is 7 mm or more, but on the other hand, for the blistering, the evaluation is poor at a surface pressure of $29.4\times10^4$ Pa (3.0 kgf/cm$^2$), is the minimum line for practical at a surface pressure of $24.5\times10^4$ Pa (2.5 kgf/cm$^2$) or less, and is good at a surface pressure of $19.6\times10^4$ Pa (2.0 kgf/cm$^2$) or less. This indicates that even in the nip area where satisfactory fixing characteristics can be obtained, if the surface pressure is high, blistering occurs, thereby resulting in poor images.

In other words, it is apparent that blistering occurs when the surface pressure exceeds a certain value, independent of the speed at which a transferring material passes through the nip portion.

Although the fixing characteristics were ensured at a surface pressure of $5.9\times10^4$ Pa (0.6 kgf/cm$^2$), the surface of the fixed images was not satisfactorily smooth and their glossiness was low; accordingly, when applying to, for example, OHP paper, its transmission is reduced. Thus, the substantial minimum line for practical use is about $5.9\times10^4$ Pa (0.6 kgf/cm$^2$).

In this embodiment, as an example, a nip about 8 mm in size was formed under the following conditions: preparing a pressurizing roller 30 that has a length of 250 mm, a diameter of 25 mm, an elastic layer 30*b* having a thickness of 4 mm and a PFA tube 30C of 50 μm thick covering the above elastic layer, selecting the product hardness of the pressurizing roller 30 measured on the PFA tube to be 56 degrees (Asker C hardness, 9.8 N (1 kg) load), selecting the width of the pressurizing rigid stay in the fixing film 10 to be 10 mm, and bringing the fixing film 10 in pressure contact with the pressurizing roller 30 at a total pressure of 196.1 N (20 kg). With this nip, satisfactory fixed images were obtained which were free from both "pore" and blistering.

Even though the glossiness of printed images changes with the concentration of toner, printed images with glossiness limited up to 30% or less (using PG-3D manufactured by Nippon Denshoku Industries Co. Ltd., incidence angle θ=75°) were obtained.

When the surface pressure in the nip is reduced, the glossiness value tends to decrease, on the other hand, when the surface pressure is raised, the glossiness value tends to increase, for the same reason as described in terms of the transmission of OHP. Therefore, if the surface pressure is controlled within the range of the above described favorable surface pressure $5.9\times10^4$ Pa to $24.5\times10^4$ Pa (0.6 kgf/cm$^2$ to 2.5 kgf/cm$^2$), the glossiness of images can be controlled to some extent. Further if the upper limit of the surface pressure is specified, the deterioration of the film can be prevented.

In the following, another embodiment of the present invention will be described.

Figure 13:
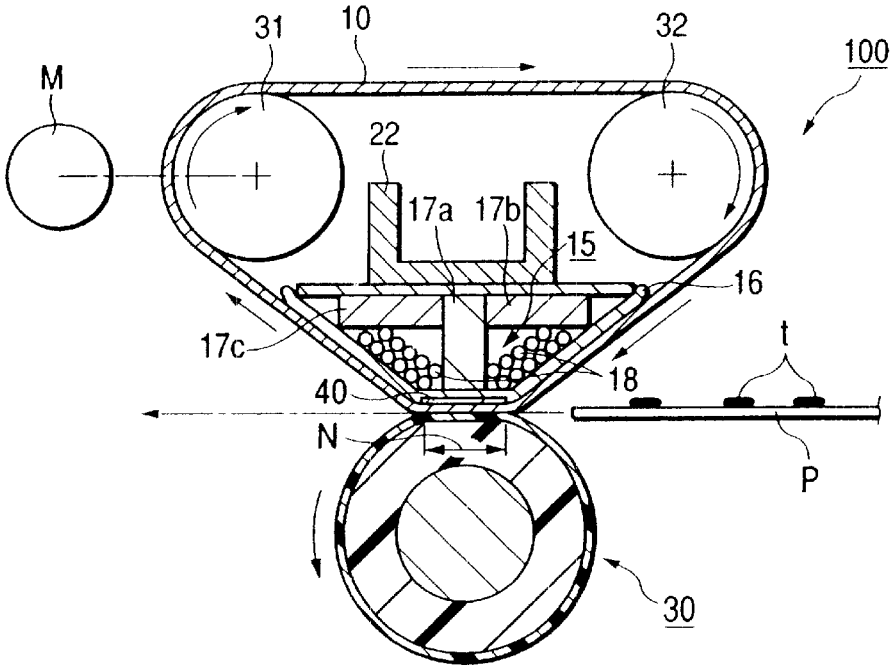
FIG. 13 is a cross-sectional side elevation of another fixing apparatus.

In the above described embodiment, the construction of the fixing apparatus 100 has been described in terms of the apparatus which adopts pressurizing roller drive fixing method; however, a driving means can be provided inside the fixing film 10. FIG. 13 is a cross-sectional side elevation of the fixing apparatus 100 in accordance with this embodiment. As shown in the figure, the fixing apparatus can be constructed in such a manner as to rig a belt guide 16, a driving roller 31 and a tension roller 32 with an electromagnetic induction heat generating fixing belt 10 in the form of a endless belt in a tightly stretched manner, form a fixing nip portion N by allowing the bottom surface of the belt guide 16 and a pressurizing roller 30, as a pressurizing member, to be in pressure contact with each other via the fixing belt 10, and rotatively drive the fixing belt 10 by the driving roller 31. In this case, the pressurizing roller 30 is a driven rotary roller.

Such a construction enables the reduction of torque when driving the fixing belt 10, which makes it easy to drive the belt 10 even if the width of the nip N is made large. Particularly in apparatus performing a high speed printing, although they are required to have an excellent fixing performance, the surface pressure in the nip cannot be increased in order to prevent the blistering problem described above; therefore, the nip width N must be enlarged, so as to gain time for fixing in the nip.

In such a case, if the fixing belt 10 is directly driven with the driving roller 31, as shown in FIG. 13, the belt 10 can be driven without any trouble even if the nip width N is made large to some extent. In this embodiment, the similar effect described in terms of the previous embodiment was obtained by selecting the surface pressures similar to those of the previous embodiment.

For example, by forming the nip N 12 mm in width with the average surface pressure of about $9.8\times10^4$ Pa (1 kgf/$cm^2$), even if the speed of the transferring material P is increased to 170 mm/sec, a satisfactory fixing performance which created no blistering was obtained, in addition, the fixing belt 10 was able to be driven easily.

Still another embodiment will be described below.

Figure 14:
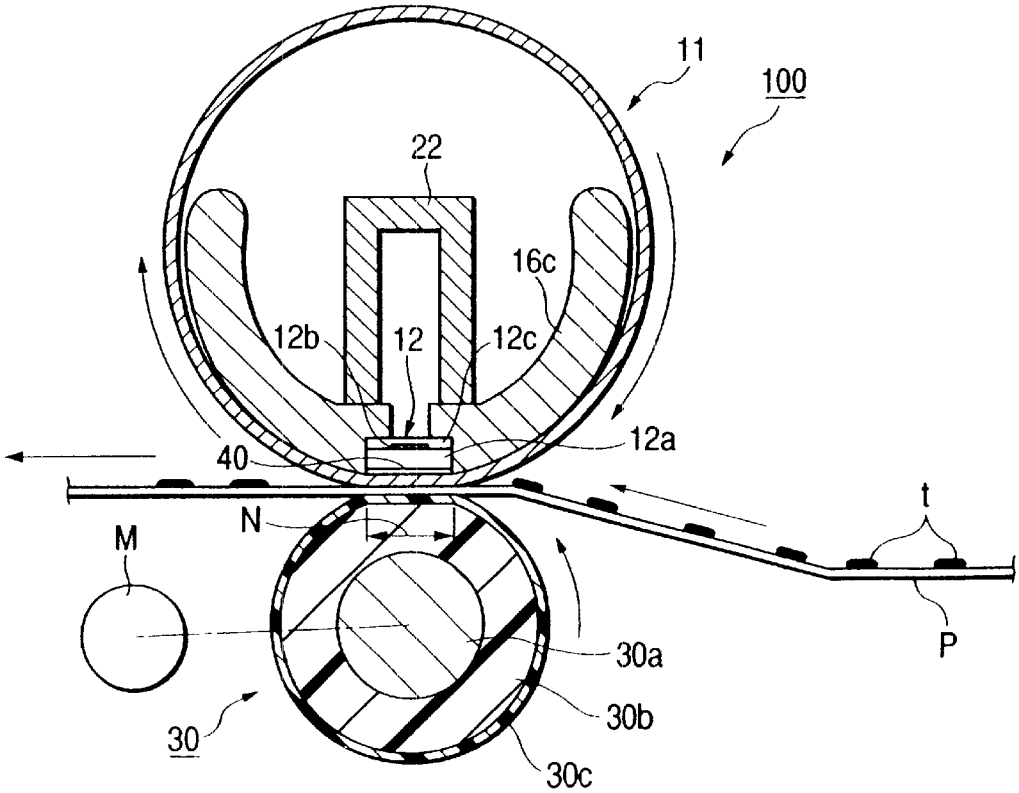
FIG. 14 is a cross-sectional side elevation of still another fixing apparatus.

The fixing apparatus in accordance with this embodiment is the apparatus adopting a film heating fixing method which uses a ceramics heater as a heating body. FIG. 14 is a schematic view in section of the fixing apparatus 100 in accordance with this embodiment.

Reference numerals 16*c* denotes a heat-resistant/heat-insulating gutter-shaped film guide member of which cross-section is almost semicircular and numeral 12 denotes a ceramic heater, as a heating body, which is fitted into a groove portion cut and provided almost in the middle portion of the bottom surface of the film guide 16*c* longitudinally along the same, so as to be fixed in and supported by the film guide.

Reference numeral 11 denotes a cylindrical or endless heat-resistant fixing film. This fixing film 11 is loose fitted on the film guide 16*c*.

Reference numeral 22 denotes a pressurizing rigid stay inserted into the inside of the film guide 16*c*.

Reference numeral 30 denotes a pressurizing member, an elastic pressurizing roller in this embodiment, consisting of a core bar 30*a* and an elastic layer 30*b* of silicone rubber and the like provided on the core bar 30*a* so as to decrease the hardness, the pressurizing member being placed in such a manner as to allow both end portions of its core bar 30*a* to be supported with respective bearings in a freely rotatable manner between the side plates of the front side and rear side chassis not shown in the figure. A fluororesin layer 30*c* of, for example, PTFE, PFA or FEP may be provided on its periphery so as to improve its surface characteristics.

A pressurizing means for forming a fixing nip N and a holding means for holding the end portions of the fixing film are constructed in the same manner as the embodiment previously described and the description thereof shall be omitted.

As a pressurizing roller 30, the same pressurizing roller as those used in the previously described embodiments can be used. The pressurizing roller 30 is rotatively driven in the counterclockwise direction shown by an arrow by a driving means M. When rotatively driving the pressurizing roller 30, torque acts on the fixing film 11 by the friction force generated between the above pressurizing roller 30 and the external surface of the fixing film 11; consequently, the above fixing film 11 is rotated around the periphery of the film guide member 16*c* at a peripheral speed almost corresponding to that of the pressurizing roller 30 in the clockwise direction shown by an arrow with its internal surface closely touching and sliding on the bottom surface of the ceramic heater 12 at the fixing nip portion N (pressuring roller drive fixing method).

In this case, a lubricating member 40 is placed on the bottom surface of the ceramic heater 12 at the fixing nip portion N and a lubricant such as heat-resistant grease is applied between the lubricating member 40 and the internal surface of the fixing film 11 so as to reduce the friction force produced by the mutual sliding between the bottom surface of the ceramic heater 12 and the internal surface of the fixing film 11 at the fixing nip portion N.

The pressurizing roller 30 is allowed to start rotating based on the print start signal and the ceramic heater 12 starts to be heated-up. In a state where the peripheral speed of the rotation the fixing film 11 by the rotation of the pressurizing roller 30 becomes steady and the temperature of the ceramic heater 12 has been raised to a predetermined point, a transferring material P, as a material to be heated, which has a toner image t formed thereon is introduced between the fixing film 11 and the pressurizing roller 30 at the fixing nip portion N with the image side facing the surface of the fixing film 11. The transfer material P closely touches the bottom surface of the ceramic heater 12 via the fixing film 11 at the fixing nip portion N and passing through the same together with the fixing film 11.

During the process of the transferring material P's passing through the fixing nip portion N, the heat of the ceramic heater 12 is transferred thereto via the fixing film 11, and the toner image t is heat fixed on the surface of the transferring material P. The transferring material P having passed through the fixing nip portion N is separated from the surface of the fixing film 11 and conveyed.

Figure 15:
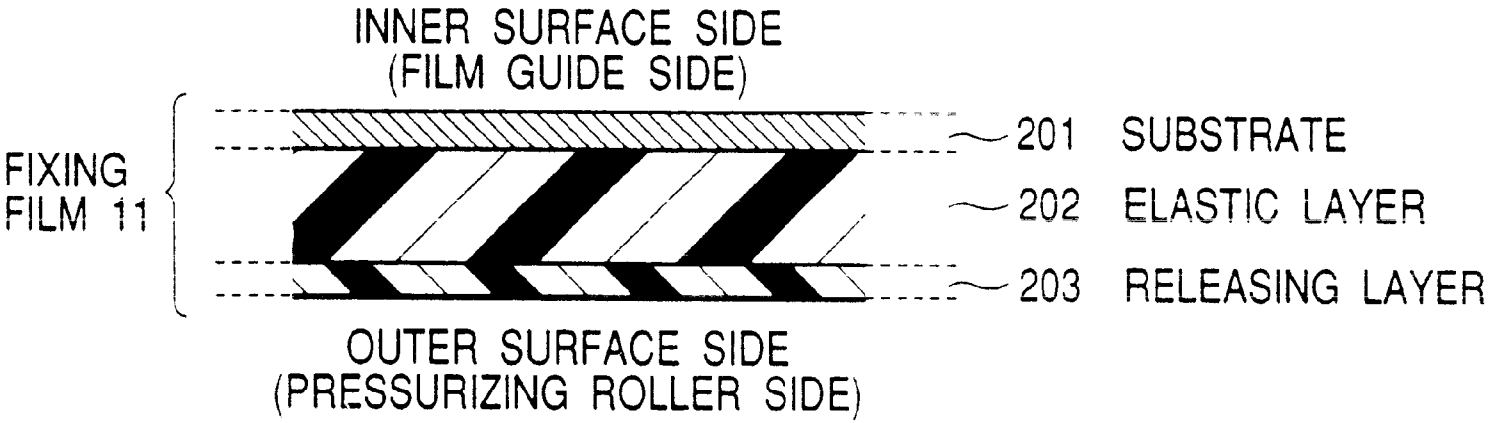
FIG. 15 is a view showing the layer construction of the fixing film shown in FIG. 14.

The fixing film 11 consists of a base layer 201, an elastic layer 202 and a releasing layer 203, as shown in FIG. 15. For the base layer 201, in order to decrease heat capacity and improve quick start characteristics, heat-resistant films of, for example, polyimide, polyimide amide, PEEK, PES, PPS, PTFE, PFA or FEP of which thickness is 100 $\mu$m or less, preferably 50 $\mu$m or less and 20 $\mu$m or more can be used. In this embodiment, a cylindrical polyimide film 25 mm in diameter was used.

For the elastic layer 202, silicone rubber was used of which rubber hardness is 10 degrees (JIS-A), heat conductivity is $4.18605\times10^{-1}$ W/m·° C. ($1\times10^{-3}$ [cal/cm·sec·deg]) and thickness is 200 $\mu$m. For the releasing layer 203, a PFA coat layer 20 $\mu$m was used. The same PFA tube as described in terms of the previous embodiment may be used for the releasing layer 203. The PFA coat is excellent in that it can be made thin, and from the standpoint of the material, it wraps toner more effectively than the PFA tube. On the other hand, in both mechanical and electrical strength, the PFA tube is superior to the PFA coat, accordingly, they can be used properly depending on the situation.

The ceramic heater 12 as a heating body is a transverse linear heating body with a low heat capacity which extends in the direction orthogonal to the direction in which the fixing film 11 and the transferring material P move. The ceramic heater 12 basically consists of a heater substrate 12*a* formed of, for example, aluminum nitride; a heat generating layer 12*b* provided on the surface of the heater substrate 12*a* along its longitudinal direction, for example, a heat generating layer 12*b* provided by coating an electrically resistant material, such as Ag/Pd (silver/palladium), about 10 $\mu$m long and 1 to 5 mm wide by the screen printing; and a protective layer 12*c* of, for example, glass and fluororesin provided on the heat generating layer 12*b*.

The heat generating layer 12*b* of the above ceramic heater 12 generates heat when electric current is applied between both ends thereof and the heater 12 is rapidly heated. The temperature of the heater 12 is controlled in such a manner as to detect temperature of the heater with a temperature sensor not shown in the figure, control current application to the heat generating layer 12*b* with a controlling circuit not shown in the figure so as to keep the heater at a prescribed temperature.

The ceramic heater 12 described above is fitted into the groove portion cut and provided almost in the middle of the bottom surface of the film guide 16*c* longitudinally along the guide with its protective layer 12*c* facing up, so as to be fixed in and supported by the film guide 16*c*. At the fixing nip portion N where the ceramic heater 12 is in contact with the fixing film 11, the surface of the sliding member 40 of the heater 12 and the internal surface of the fixing film 11 come in contact with each other and slide.

In this embodiment, the similar effect described in terms of the previous embodiments was obtained by selecting the surface pressures similar to those of the previous embodiments.

In the apparatus of the above construction, when forming the nip about 8 mm in width by bringing the fixing film 11 and the pressurizing roller 30 into contact with each other under the total pressure of 147.1 N (15 kg), the use of the same wax-containing toner as described in terms of the previous embodiment allowed a satisfactorily fixed image to be produced which was free from "su (pores)" and blistering.

In the embodiments described so far, wax-containing toners have been described taking the case where the spherical toners produced by the polymerization method are used; however, the present invention is also effective when using the non-spherical or almost spherical wax-containing toners produced by the pulverizing method.

Further, the fixing apparatus adopting the electromagnetic heat generating fixing method in accordance with the embodiment described above has its heat generating portion close to the nip and is particularly excellent in response to heat; therefore, it can be suitably used not only for printing apparatus using a single photosensitive body, as shown in FIG. 1, but also for, for example, inline-type printers which are capable of full color printing in a batch using 4 photosensitive bodies, and quick start and oilless fixing can be realized of which characteristics never deteriorate even when performing high-speed continuous printing.

Further film fixing members 10, 11 are not limited to those in the cylindrical or endless belt form. They may be rolls of continuous web-like members having ends which are let out and allowed to run.

In the fixing apparatus in accordance with one embodiment of the present invention shown in FIG. 4, a film was used for a fixing member, however, a rigid roller can also be used for the same.

As described so far, according to the present invention, a full color fixing system requiring no oil application means can be constructed, and at the same time, images free from defects, such as blistering and "su (pores)", and having glossiness not too high, that is, having a satisfactory gloss value are obtained by using toners which contain wax in their binder and have a MI value in the range of 0.5 to 100 g and by pressing a recording material against the fixing member under a nip surface pressure of 5.9 Pa to 24.5 Pa (0.6 kgf/cm$^2$ to 2.5 kgf/cm$^2$) by a pressurizing means. In addition, heating the above fixing member using the electromagnetic induction method or the direct heating method enables the construction of an energy-saving-type fixing system which is capable of quick starting.

In other words, the present invention makes it possible to use fixing apparatus adopting the film heating fixing method or electromagnetic induction heating fixing method in the fixing operation of full color toner images in an oilless manner without causing any troubles, as a result, a full color fixing system requiring no releasing agent (oil) application, ensuring satisfactory fixing performance, and capable of quick starting is constructed.

While the present invention has been described in terms of its preferred embodiments, it should be understood that the present invention is not intended to be limited to those embodiments and various changes and modifications can be made in it without departing the spirit and scope thereof.

What is claimed is:

1. An image forming apparatus, comprising:

unfixed toner image forming means for forming an unfixed toner image on a recording material; and fixing means for fixing the unfixed toner image formed on the recording material by heating and pressurizing, wherein said fixing means includes a film, a first back up member and a second back up member forming a nip together with said first backup member while nipping said film, and wherein the recording material moves between said film and said second back up member, wherein toner of the unfixed toner image contains a releasing agent in a binder which contains a coloring material ingredient and have a melt index value of 0.5 g or more and 100 g or less in accordance with a Melt Index measuring method, and wherein an average surface pressure at the nip portion is $5.9\times10^4$ Pa or more and $24.5\times10^4$ Pa or less.

2. An image forming apparatus according to claim 1, wherein the unfixed toner image is formed of plural different colored toners.

3. An image forming apparatus according to claim 1, wherein said film includes an elastic layer.

4. An image forming apparatus according to claim 3, wherein hardness of said elastic layer is 30 degrees or less (JIS-A).

5. An image forming apparatus according to claim 4, wherein hardness of said elastic layer is 25 degrees or less (JIS-A).

6. An image forming apparatus according to claim 3, wherein said film includes a releasing layer coming into contact with the unfixed toner image, following equations:

$$50\ \mu m \leqq t1 \leqq 500\ \mu m$$

$$5\ \mu m \leqq t2 \leqq 100\ \mu m$$

$$t1 \geqq 3\times t2$$

being satisfied where t1 is a thickness of said elastic layer and t2 is a thickness of said releasing layer.

7. An image forming apparatus according to claim 1, wherein said film is a rotating body.

8. An image forming apparatus according to claim 1 further comprising magnetic flux generating means, wherein an eddy current is generated in said film by a magnetic flux from said magnetic flux generating means and said film generates heat.

9. An image forming apparatus according to claim 1, wherein said first back up member is a heating body which generates heat when supplying power thereto.

10. An image forming apparatus according to claim 1, wherein said second back up member is an elastic roller.

11. An image forming apparatus according to claim 10, wherein a surface hardness of said elastic roller is 45 degrees or higher and 75 degrees or lower (Asker C hardness).

12. An image forming apparatus, comprising:

unfixed toner image forming means for forming unfixed toner images; and fixing means for fixing on a recording material the unfixed toner image formed by said unfixed toner image forming means;

wherein said fixing means includes a fixing member, a back up member in contact with said fixing member, and a magnetic flux generating means for generating magnetic flux, wherein an eddy current is generated in said fixing member by a magnetic flux from said magnetic flux generating means and said fixing means generates heat, the recording material bearing the unfixed toner image is nipped and conveyed at a contact portion of said fixing member and said back up member, thereby the unfixed toner image is fixed on the recording material, wherein toner of the unfixed toner image contains a releasing agent in a binder which contains a coloring material ingredient and have a melt index value of 0.5 g or more and 100 g or less in accordance with a Melt Index measuring method, and wherein an average surface pressure at said contact portion is $5.9\times10^4$ Pa or more and $24.5\times10^4$ Pa or less.

13. An image forming apparatus according to claim 12, wherein the unfixed toner image is formed of plural different colored toners.

14. An image forming apparatus according to claim 12, wherein said fixing member includes an elastic layer.

15. An image forming apparatus according to claim 14, wherein hardness of said elastic layer is 30 degrees or less (JIS-A).

16. An image forming apparatus according to claim 15, wherein hardness of said elastic layer is 25 degrees or less (JIS-A).

17. An image forming apparatus according to claim 14, wherein said fixing member includes a releasing layer coming into contact with the unfixed toner image, following equations:

$$50\ \mu m \leqq t1 \leqq 500\ \mu m$$

$$5\ \mu m \leqq t2 \leqq 100\ \mu m$$

$$t1 \geqq 3\times t2$$

being satisfied where t1 is a thickness of said elastic layer and t2 is a thickness of said releasing layer.

18. An image forming apparatus according to claim 12, wherein said back up member is an elastic roller.

19. An image forming apparatus according to claim 18, wherein surface hardness of said elastic roller is 45 degrees or higher and 75 degrees or lower (Asker C hardness).

* * * * *

UNITED STATES PATENT AND TRADEMARK OFFICE

CERTIFICATE OF CORRECTION

PATENT NO. : 6,505,027 B2 
DATED : January 7, 2003
INVENTOR(S) : Akihiko Takeuchi and Masahiro Suzuki It is certified that error appears in the above-identified patent and that said Letters Patent is hereby corrected as shown below:

Title page,
Item [56], References Cited, FOREIGN PATENT DOCUMENTS, "JP 410293426 11/1998" should read -- JP 10-293426 11/1998 --.
Item [57], ABSTRACT,
Line 15, "have" should read -- has --.

Column 2,
Line 52, "filed" should read -- field --.

Column 3,
Line 62, "electophotographic" should read -- electrophotographic --.

Column 4,
Line 29, "what" should read -- that --.

Column 6,
Line 5, "have" should read -- has --.
Line 22, "thereby" should read -- whereby --.
Line 25, "have" should read -- has --.

Column 9,
Line 5, "thereby" should read -- whereby --.

Column 10,
Line 59, "zensufonate" should read -- zenesulfonate --.

Column 12,
Line 1, "in" should read -- In --.
Line 15, "all for" should read -- for all --.

Column 13,
Line 35, "is" should read -- are --.

Column 16,
Line 14, "small-gage" should read -- small-gauge --.
Line 17, "turns" should read -- turn --.
Line 20, "insulting" (both occurrences) should read -- insulating --.
Line 36, "fluororesine," should read -- fluororesin, --.

UNITED STATES PATENT AND TRADEMARK OFFICE

CERTIFICATE OF CORRECTION

PATENT NO. : 6,505,027 B2
DATED : January 7, 2003
INVENTOR(S) : Akihiko Takeuchi and Masahiro Suzuki It is certified that error appears in the above-identified patent and that said Letters Patent is hereby corrected as shown below:

Column 17,
Lines 2 and 4, "thereby" should read -- whereby --.
Line 21, "frequency" should read -- the frequency --.
Line 35, "deteriorate;" should read -- deteriorates. --; and "accordingly," should read -- Accordingly, --.
Line 43, "fuluorosilicone" should read -- fluorosilicone --.
Line 46, "arts." should read -- art. --.
Line 56, "meter" should read -- meter, --.

Column 19,
Line 12, "passing" should read -- passes --.

Column 21,
Line 13, "numerals" should read -- numeral --.
Line 34, "not" should read -- (not --; and "figure." should read -- figure). --.

Column 22,
Line 58, "not" should read -- (not --; and "figure," should read -- figure), --.
Line 59, "not" should read -- (not --.
Line 60, "figure" should read -- figure), --.

Column 23,
Line 67, "departing" should read -- departing from --.

Column 24,
Line 14, "have" should read -- has --.
Line 32, "following" should read -- the following --.

Column 25,
Line 4, "thereby" should read -- whereby --.
Line 8, "have" should read -- has --.

UNITED STATES PATENT AND TRADEMARK OFFICE

CERTIFICATE OF CORRECTION

PATENT NO. : 6,505,027 B2
DATED : January 7, 2003
INVENTOR(S) : Akihiko Takeuchi and Masahiro Suzuki It is certified that error appears in the above-identified patent and that said Letters Patent is hereby corrected as shown below:

Column 26,
Line 6, "following" should read -- the following --.

Signed and Sealed this

Ninth Day of September, 2003

JAMES E. ROGAN
*Director of the United States Patent and Trademark Office*